US006289960B1

(12) United States Patent
Isowa

(10) Patent No.: US 6,289,960 B1
(45) **Date of Patent: *Sep. 18, 2001**

(54) APPARATUS HAVING A WRAPPED ROLL FOR MAKING A SINGLE FACED CORRUGATED BOARD

(75) Inventor: Eiichi Isowa, Aichi (JP)

(73) Assignee: Kabushiki Kaisha Isowa, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/789,925

(22) Filed: Jan. 28, 1997

(30) Foreign Application Priority Data

May 14, 1996 (JP) ..... 8-145092

(51) Int. Cl.[7] ..... B31F 1/28
(52) U.S. Cl. ..... 156/472; 156/471
(58) Field of Search ..... 156/205, 210, 156/470, 471, 472; 425/369

(56) References Cited

U.S. PATENT DOCUMENTS

| | | | | |
|---|---|---|---|---|
| 1,199,508 | * | 9/1916 | Swift, Jr. | 156/210 |
| 2,979,112 | * | 4/1961 | Wilson | 156/473 |
| 3,004,880 | * | 10/1961 | Lord | 156/210 |
| 5,344,520 | * | 9/1994 | Seki et al. | 156/472 |
| 5,389,183 | * | 2/1995 | Seki et al. | 156/472 |
| 5,614,048 | * | 3/1997 | Barny et al. | 156/472 |
| 5,685,929 | * | 11/1997 | Bettinelli et al. | 156/472 |
| 5,783,006 | * | 7/1998 | Klockenkemper et al. | 156/205 |
| 6,068,724 | * | 5/2000 | Barny et al. | 156/205 |

FOREIGN PATENT DOCUMENTS

| | | | |
|---|---|---|---|
| 0 559 556 | | 9/1993 | (EP) . |
| 753400A | * | 1/1997 | (EP) . |
| 0 850 754 | | 7/1998 | (EP) . |
| 2708011 | * | 1/1995 | (FR) . |
| 6286032A | * | 10/1994 | (JP) . |
| WO 95/30537 | * | 11/1995 | (WO) . |

* cited by examiner

*Primary Examiner*—Michael W. Ball
*Assistant Examiner*—Barbara J. Musser
(74) *Attorney, Agent, or Firm*—Jacobson Holman, PLLC

(57) ABSTRACT

A single facer containing a first corrugating roll, a second corrugating roll and a gluing mechanism further has an introducing device which is disposed to oppose the second corrugating roll across the liner feed line and pressed against the second corrugating roll via a corrugating medium and a liner; a wrapped roll disposed to oppose the second corrugating roll across the liner feed line on the downstream side of the introducing device with respect to the liner feed direction such that it may not bring the corrugating medium and the liner into press contact with the second corrugating roll, the wrapped roll being driven to rotate at a variable circumferential speed relative to that of the second corrugating roll; a wrapping roll for wrapping the corrugating medium and the liner around the wrapped roll, disposed to oppose the wrapped roll across the feed line, the position of the wrapping roll being adjustable along the circumference of the roll; and a position adjusting mechanism for moving the wrapping roll along the circumference of the wrapped roll so as to change the wrapping area thereon; wherein full adhesion between the corrugating medium and the liner having been subjected to initial adhesion between the second corrugating roll and the introducing device is designed to be achieved by the tension to be generated by the difference between the circumferential speed of the wrapped roll and that of the second corrugating roll.

13 Claims, 15 Drawing Sheets

APPARATUS HAVING A WRAPPED ROLL FOR MAKING A SINGLE FACED CORRUGATED BOARD

BACKGROUND OF THE INVENTION

1. Field of the Invention

This invention relates to a single facer for forming a single-faced corrugated fiberboard by pasting a liner with a corrugating medium having flutes formed when it was passed through a gap defined between a first corrugating roll and a second corrugating roll each having wavy flutes formed on the circumference.

2. Description of the Related Art

In an apparatus for forming a single-faced corrugated fiberboard (hereinafter referred to as a single facer), a first corrugating roll and a second corrugating roll each having wavy flutes formed on the circumference are rotatably supported by frames in a vertical relationship in such a way that they may engage with each other by their flutes, and a press roll is designed to be pressed against the second corrugating roll via a corrugating medium and a liner which are webs of the single-faced corrugated fiberboard. Namely, the corrugating medium, which is fed to and between the first corrugating roll and the second corrugating roll, is allowed to have a predetermined corrugation (flutes) when it is passed between these rolls. A starchy glue is applied to the tips of flutes thus formed by a gluing roll provided in a gluing mechanism. Meanwhile, the liner being fed from the opposite side with respect to the corrugating medium via the press roll is pressed against the glued flute tips of the corrugating medium, between the press roll and the second corrugating roll, to be pasted together and form a single-faced corrugated fiberboard.

The press roll employed in the conventional single facer is of a large-diameter metallic roll which is normally urged toward the second corrugating roll so as to apply a predetermined nip pressure to the corrugating medium glued at the flute tips and the liner passing between these rolls and form a single-faced corrugated fiberboard. Since flutes consisting of alternative repetition of crests and troughs are formed continuously at a predetermined pitch on the circumference of the second corrugating roll, the distance between the rotation center of the second corrugating roll and that of the press roll shift slightly as the point of press contact of the second corrugating roll shifts from the trough to the crest or vice versa. Thus, as the result that the rotation centers of these rolls make cyclic reciprocating motions to be closer or farther relative to each other as they rotate, great vibration and big noise are generated during formation of the single-faced corrugated fiberboard, causing the working environment in the plant to be worsened considerably. Besides, such relative periodical shift of the rotation centers of these rolls causes the crests of the second corrugating roll to hit periodically the surface of the press roll to apply impact (so-called the hammering phenomenon). Accordingly, linear press marks corresponding to the pitch of the crests of the second corrugating roll are formed crosswise on the surface of the liner in the thus formed single-faced corrugated fiberboard, disadvantageously. The problems described above are brought about by the great nip pressure secured between the second corrugating roll and the press roll, which is required to nip the corrugating medium and the liner at one line contact between the second corrugating roll and the press roll opposing each other and to paste them together.

SUMMARY OF THE INVENTION

The present invention is proposed in view of the problems inherent in the prior art, as described above, and in order to solve them successfully, and it is an objective of this invention to provide a single facer which can reduce not only vibration or noises to be generated when a single-faced corrugated fiberboard is formed but also press marks to be formed on the liner.

In order to solve the above-described problems and attain the intended object suitably, one aspect of this invention is to provide a single facer.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiment taken in conjunction with the accompanying drawings in which:

DETAILED DESCRIPTION OF THE PREFERRED EMBODIMENTS

The single facer according to this invention will now be described by way of preferred embodiments referring to the attached drawings.

(First Embodiment)

Figure 1:
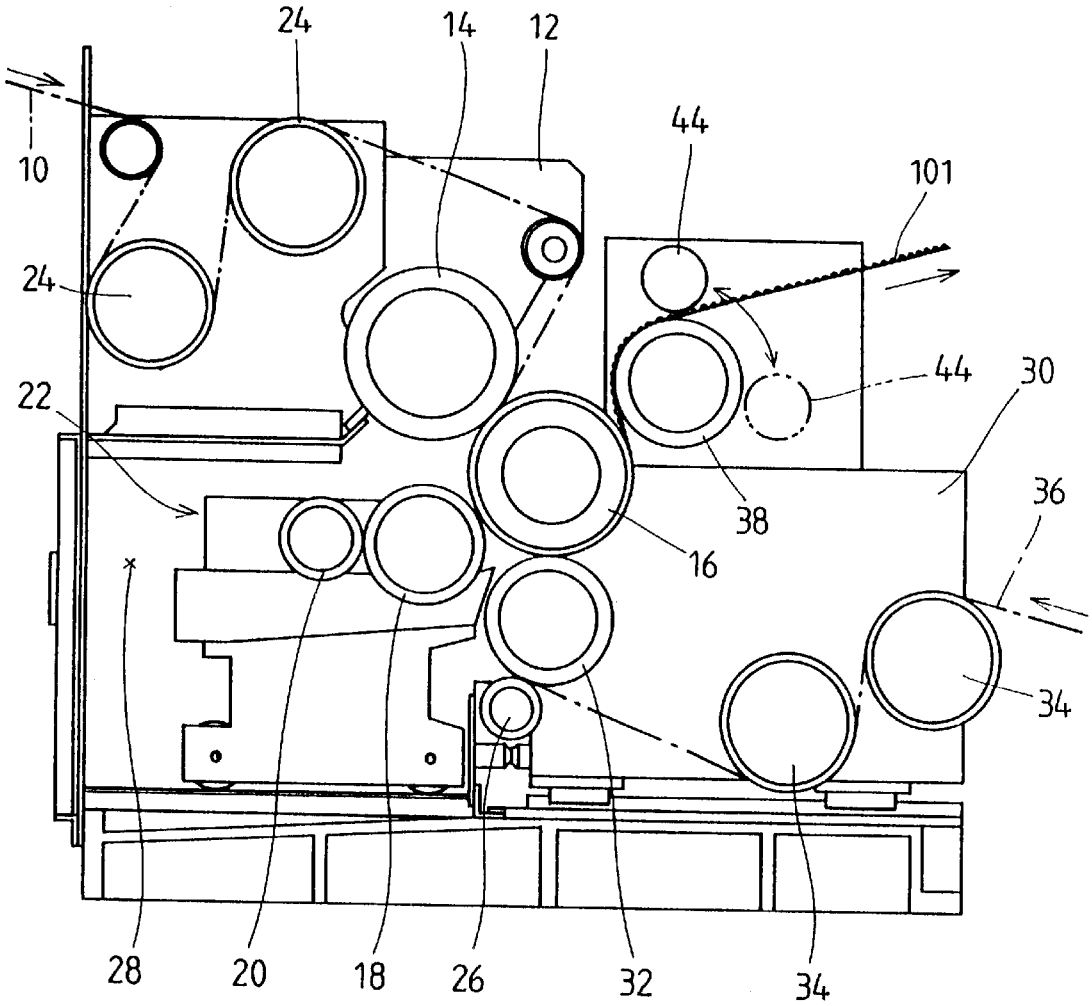
FIG. 1 is schematic constitutional view of a single facer according to a first embodiment of the invention.

FIG. 1 shows schematically a constitutional view of a single facer according to a first embodiment of the invention.

A first corrugating roll 14 having wavy flutes formed on the circumference and a second corrugating roll 16 also having flutes formed on the circumference are rotatably supported between a pair of main frames 12 (only one frame is shown in FIG. 1) disposed to be spaced from each other orthogonal to the direction of feeding a corrugating medium 10 (to be described later). The rotary shaft of the first corrugating roll 14 locates diagonally above that of the second corrugating roll 16, and the flutes of the first corrugating roll 14 are designed to be engageable with those of the second corrugating roll 16 via the corrugating medium 10. Meanwhile, a gluing mechanism 22 consisting of a gluing roll 18 and a doctor roll 20 is disposed immediately below the first corrugating roll 14 and diagonally below the second corrugating roll 16. The corrugating medium 10 is fed from a web supply source (not shown) assumed to be located on the left side in FIG. 1, via a plurality of guide rolls 24, to an engagement zone defined between the first corrugating roll 14 and the second corrugating roll 16 to be corrugated as required when it is passed through the engagement zone. The thus corrugated corrugating medium 10 is glued at the flute tips by the gluing mechanism 22 and then diverted upward along the circumference of the second corrugating roll 16. The corrugating medium 10 is also designed to be heated by hot steam distributed from a supply source (not shown) into the guide roll 24.

The gluing mechanism 22 is housed in a substantially closed pressure chamber 28 which opens toward the first corrugating roll 14 and the second corrugating roll 16, and which is sealed between the opening and the first corrugating roll 14 and between the opening and a seal roll 26 locating immediately below the second corrugating roll 16. Compressed air is supplied into this pressure chamber 28 from a supply source (not shown) so that the internal pressure of the pressure chamber 28 may be slightly higher (e.g. by 0.15 atm.) than the atmospheric pressure. Circumferential grooves (not shown) are defined on the surface of the second corrugating roll 16, so that the outer surface of the roll 16 facing the pressure chamber 28 may assume atmospheric pressure. Accordingly, the corrugating medium 10 corrugated by passing between the first and second corrugating rolls 14,16 is stably fed as pressed against the roll surface by the difference between the internal pressure of the pressure chamber 28 and the pressure on the outer surface of the second corrugating roll 16.

A pair of sub frames 30 are disposed on the opposite side of the second corrugating roll 16 from the corrugating medium feeding side (i.e. on the right side in FIG. 1) to be spaced from each other in the same direction as in the case of the main frames 12, and these sub frames 30 are adapted to be moved closer to and farther from the main frames 12 by a carrier (not shown). A roll 32 serving as an introducing device is rotatably supported between these sub frames 30 and is designed to locate immediately below the second corrugating roll 16 when the sub frames 30 are positioned at operational positions adjacent to the main frames 12 respectively. A liner 36 to be supplied from a web supply source (not shown) assumed to be located on the right side in FIG. 1 through a pair of steam-heated roll-like preheaters 34 to the roll 32 is designed to be pressed against the corrugating medium 10 fed along the circumference of the second corrugating roll 16 with a predetermined nip pressure. This roll 32 functions to achieve initial adhesion between the corrugating medium 10 and the liner 36, and the roll 32 is designed to give a small nip pressure so as not to form press marks on the liner (for example, about 60% of the nip pressure required for achieving full adhesion between the corrugating medium 10 and the liner 36).

A high-temperature steam is distributed from a source (not shown) into the first corrugating roll 14 and the second corrugating roll 16 so that the rolls 14,16 may be heated to a predetermined temperature to apply heat to the gluing portions of the corrugating medium 10 and the liner 36 to be brought into contact with the rolls 14,16.

The second corrugating roll 16 is driven by a motor M1 (to be described later) being controlled to rotate at a circumferential speed corresponding to the speed of feeding the corrugating medium 10 and the liner 36 (line speed). Meanwhile, the roll 32, which is supported rotatably by the sub frames 30, is designed to be driven by the second corrugating roll 16, pressed against the roll 32 via the corrugating medium 10 and the liner 36, at the same circumferential speed. Incidentally, the roll 32 may be connected to the driving system of the second corrugating roll 16 via gears and the like so as to drive the roll 32 positively at the same circumferential speed as that of the second corrugating roll 16.

A wrapped roll 38, which is opposed to the second corrugating roll 16 across the line of feeding the liner 36, is rotatably supported between the sub frames 30 at a position spaced from the roll 32 toward the downstream side (upper side in FIG. 1) with respect to the direction of feeding the corrugating medium 10. This wrapped roll 38 is positioned so as not to bring the corrugating medium 10 and the liner 36 into press contact with the second corrugating roll 16. Further, the wrapped roll 38 is driven by a motor M2 (to be described later) so as to rotate at a circumferential speed a predetermined rate higher than the circumferential speed of the second corrugating roll 16, and the thus produced difference between the circumferential speed of the second corrugating roll 16 (roll 32) and that of the wrapped roll 38 is adapted to apply tension to the corrugating medium 10 and the liner 36 present between the roll 32 and the wrapped roll 38. More specifically, the tension to be applied by the wrapped roll 38 acts as a force of pressing the liner 36 against the corrugating medium 10 fed along the circumference of the second corrugating roll 16, whereby to achieve bonding between these webs 10,36. Incidentally, it is recommended that the wrapped roll 38 should be subjected to matting treatment which can increase contact resistance on the circumference or wrapped with a urethane sheet or the like so as to ensure application of tension to the liner 36.

The roll 32 and the wrapped roll 38 are connected to the hot steam supply source (not shown) which distributes a high-temperature steam into the rolls 32,38 to heat the surface of each roll to a predetermined temperature. Thus, the liner 36 brought into contact with the roll 32 and the wrapped roll 38 is heated to apply heat to the gluing portions of the corrugating medium 10 and the liner 36, so that gelation of a starchy glue may be accelerated to ensure bonding between the liner 36 and the corrugating medium 10. The roll 32 is also adapted to be abutted against the seal roll 26 when the sub frames 30 are positioned at the operational positions to maintain the pressure chamber 28 to assume a hermetically sealed state (see FIG. 1). Incidentally, the roll 32 is adapted to be positioned at a retracted position spaced from the second corrugating roll 16 by spacing the sub frames 30 farther from the main frames 12 respectively.

Figure 3:
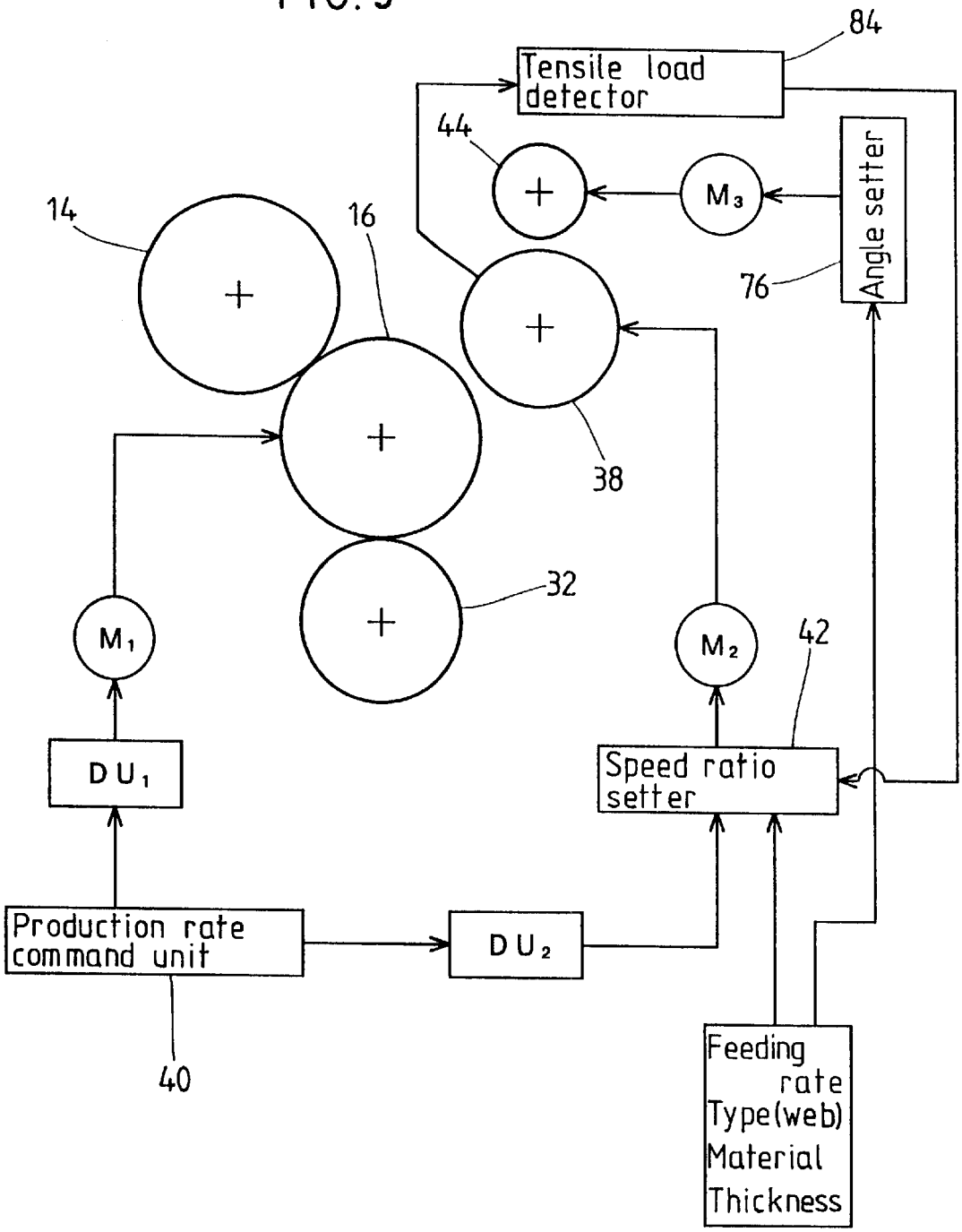
FIG. 3 is a block diagram showing the drive control system in the single facer according to the first embodiment.

As shown in FIG. 3, control signals output from a production rate command unit 40 are given via a drive unit DU1 to the motor M1 for rotationally driving the second corrugating roll 16, and to control the motor M1 so as to drive the second corrugating roll 16 to rotate at a circumferential speed corresponding to the speed of feeding the corrugating medium 10 and the liner 36 (the line speed).

Further, the variable motor M2 as a drive unit is connected to the wrapped roll 38 so that control signals output from the production rate command unit 40 may be given via a drive unit DU2 and a speed ratio setter 42 to the motor M2. Data for controlling the motor M2 to rotate the wrapped roll 38 at a speed a predetermined ratio higher than the circumferential speed of the second corrugating roll 16 are inputted beforehand to this speed ratio setter 42. Thus, the circumferential speed of the wrapped roll 38 is maintained constantly higher than that of the second corrugating roll 16 to apply tension to the corrugating medium 10 and the liner 36 present between the roll 32 and the wrapped roll 38. Various production conditions such as feeding speed, type, material and thickness of the corrugating medium 10 and the liner 36 are adapted to be inputted to the speed ratio setter 42. Incidentally, when there is any change in the production conditions such as feeding speed, type, material and thickness of the corrugating medium 10 and the liner 36, an appropriate tension can be applied to the corrugating medium 10 and the liner 36 depending on the conditions by changing the data to be inputted to the speed ratio setter 42.

Meanwhile, the tension to be applied by the wrapped roll 38 to the corrugating medium 10 and the liner 36 is detected by a tensile load detector 84 shown in FIG. 3, and the tension detected by the detector 84 is adapted to be inputted to the speed ratio setter 42. In other words, the circumferential speed of the wrapped roll 38 is designed to be controlled variably by constantly monitoring the tension to be applied to the corrugating medium 10 and the liner 36 such that the tension may constantly be at an appropriate value. Incidentally, it is also possible to feed the corrugating medium 10 and the liner 36 without applying tension thereto by driving the wrapped roll 38, as necessary, at a circumferential speed equal to or slightly lower than that of the second corrugating roll 16. As the tensile load detector 84, one having a structure for detecting tension directly from the actual tensity of the corrugating medium 10 or the liner 36 or one having a structure for detecting tension from the load to be applied to the variable motor M2 for driving the wrapped roll 38 can be suitably employed.

A wrapping roll 44 is rotatably disposed to oppose the wrapped roll 38 across the line of feeding the corrugating medium 10 and the liner 36 having been subjected to initial adhesion and fed along the wrapped roll 38, and the corrugating medium 10 and the liner 36 having completed initial adhesion are adapted to be wrapped by the wrapping roll 44 around the wrapped roll 38. This wrapping roll 44 is adapted to be moved by a position adjusting mechanism 46 shown in FIG. 2 in the circumferential direction of the wrapped roll 38 to change the wrapping area of the wrapped roll 38 over which the corrugating medium 10 and the liner 36 are wrapped and to ensure application of tension by the wrapped roll 38 to the liner 36 depending on various production conditions including feeding speed, type, material, thickness, etc. of the corrugating medium 10 and the liner 36. As the wrapping roll 44, it is recommend to employ one which is made of a highly frictional urethane material and has a smooth surface.

Figure 2:
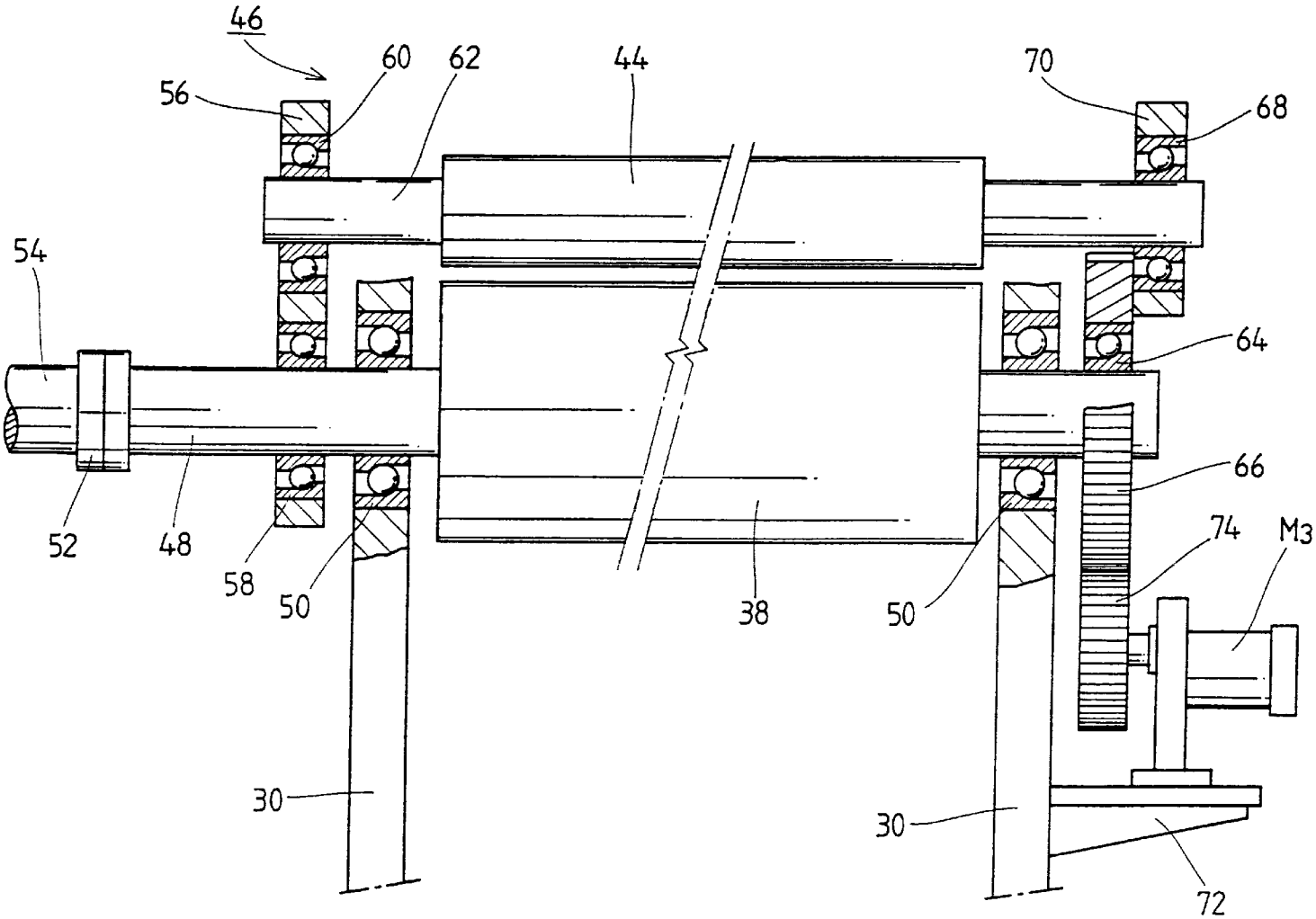
FIG. 2 is a partially cut-away front view of the position adjusting mechanism for the wrapping roll.

As the position adjusting mechanism 46, one having a constitution, for example, shown in FIG. 2 is employed. The wrapped roll 38 is rotatably supported at the rotary shaft 48 thereof via a pair of bearings 50 on the sub frames 30. A drive shaft 54 connected to the motor M2 is connected via a coupling 52 to the end portion of the rotary shaft 48 protruding outward from the sub frame 30 locating on the drive side (left side in FIG. 2) so that the wrapped roll 38 may be driven to rotate at a circumferential speed a predetermined rate higher than that of the second corrugating roll 16. A pivotal frame 56 on the drive side is pivotally supported at the proximal end portion via a bearing 58 on the rotary shaft 48 of the wrapped roll 38 at the portion protruding outward from the drive-side sub frame 30, whereas the rotary shaft 62 of the wrapping roll 44 is pivotally supported via a bearing 60 at the other end portion of this drive-side pivotal frame 56. A large-diameter gear 66 is rotatably supported via a bearing 64 on the rotary shaft 48 of the wrapped roll 38 at the portion protruding outward from the sub frame 30 on the operation side (right side in FIG. 2). A pivotal frame 70 on the operation side rotatably supported via a bearing 68 on the rotary shaft 62 of the wrapping roll 44 at the portion protruding outward toward the operation side, so that the operation-side pivotal frame 70 may turn with the rotation of the large-diameter gear 66. More specifically, the wrapping roll 44 is located a predetermined distance away from the wrapped roll 38 to be parallel therewith via the drive-side pivotal frame 56, the operation-side pivotal frame 70 and the large-diameter gear 66, and the wrapping roll 44 is also designed to be moved with the rotation of the large-diameter gear 66 in the circumferential direction with the predetermined distance being kept from the wrapped roll 38.

Figure 4:
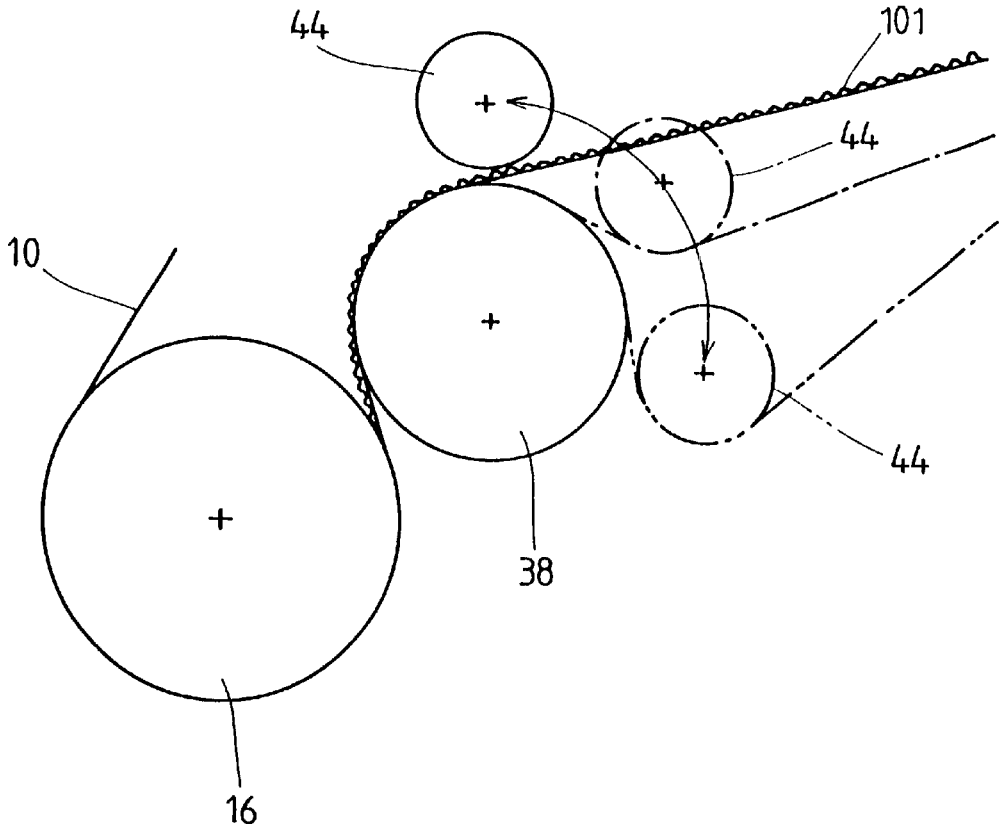
FIG. 4 is an explanatory view showing a positional relationship between the wrapped roll and the wrapping roll.

An adjust motor M3 which rotates in the positive and negative directions is disposed via a bracket 72 to the operation-side sub frame 30, and a gear 74 attached to the output shaft of the motor M3 is engaged with the large-diameter gear 66. More specifically, when the adjust motor M3 is driven to rotate in the positive or negative direction, the wrapping roll 44 is moved in the circumferential direction of the wrapped roll 38, as shown in FIG. 4, with the rotation of the large-diameter gear 66. Thus, the wrapping area of the wrapped roll 38 over which the corrugating medium 10 and the liner 36 are wrapped can be changed. Incidentally, an angle detector (not shown) is disposed to the adjust motor M3. This angle detector detects the current position of the wrapping roll 44 to be moved by the motor M3 to input the angle value thus detected to an angle setter 76 for controlling the rotation of the adjust motor M3. As shown in FIG. 3, various production conditions including feeding speed, type, material, thickness, etc. of the corrugating medium 10 and the liner 36 are inputted to the angle setter 76, and the wrapping area of the wrapped roll 38 over which the corrugating medium 10 and the liner 36 are wrapped is set depending on these conditions.

(Action of the First Embodiment)

Actions of the single facer according to the first embodiment of the invention will be described. In forming a single-faced corrugated fiberboard 101, the roll 32 is moved closer to the second corrugating roll 16 so that it can bring the corrugating medium 10 and the liner 36 being fed along the circumference of the second corrugating roll 16 into press contact with the surface of the second corrugating roll 16. The nip pressure of the roll 32 in this instance is such a small level that it can achieve initial adhesion between the corrugating medium 10 and the liner 36 and that no press mark is formed on the liner 36. Further, the wrapping roll 44 is moved in the circumferential direction of the wrapped roll 38 via the position adjusting mechanism 46 so as to provide an appropriate wrapping area on the wrapped roll 38 depending on various production conditions including feeding speed, type, material, thickness, etc. of the corrugating medium 10 and the liner 36.

The first corrugating roll 14 and the second corrugating roll 16 are driven to rotate, while the wrapped roll 38 is driven by the motor M2 to rotate at a circumferential speed a predetermined rate higher than that of the second corrugating roll 16. Incidentally, the circumferential speed of the wrapped roll 38 is set at a suitable level depending on various production conditions including feeding speed, type, material, thickness, etc. of the corrugating medium 10 and the liner 36. For example, when the corrugating medium 10 and the liner 36 have a small thickness, the difference between the circumferential speed of the wrapped roll 38 and that of the second corrugating roll 16 is set to a small value; whereas when they have a large thickness, the difference in the circumferential speed is set to a great value.

The corrugating medium 10 supplied from the web supply source through the guide rolls 24 to the engagement zone between the first corrugating roll 14 and the second corrugating roll 16 is corrugated as required when it is passed through that zone. The thus corrugated corrugating medium 10 is glued at the flute tips by the gluing mechanism 22 and then diverted upward along the circumference of the second corrugating roll 16 (see FIG. 1). Meanwhile, the liner 36 supplied from the web supply source via the preheaters 34 is fed to the bonding zone defined between the second corrugating roll 16 and the roll 32. The liner 36 is pressed against the flute tips of the corrugating medium 10 between the roll 32 and the second corrugating roll 16 to achieve initial adhesion with the corrugating medium 10. As describe above, since the nip pressure set for the roll 32 is small, press marks are scarcely formed on the liner when the corrugating medium 10 and the liner 36 are subjected to initial adhesion. Incidentally, the roll 32 is driven by the second corrugating roll 16 brought into press contact therewith via the corrugating medium 10 and the liner 36 to rotate at the same circumferential speed as that of the roll 16. More specifically, the speed of feeding the liner 36 at the site where initial adhesion between the corrugating medium 10 and the liner 36 is to be achieved is the same as the circumferential speed of the second corrugating roll 16.

The corrugating medium 10 and liner 36 underwent the initial adhesion as nipped between the second corrugating roll 16 and the roll 32 is then fed along the circumference of the second corrugating roll 16 to the location of the wrapped roll 38. In this instance, since the circumferential speed of the wrapped roll 38 is set to be higher than that of the second corrugating roll 16 or the roll 32, the corrugating medium 10 and the liner 36 fed along the roll 32 is pulled toward the wrapped roll 38 by the difference between the circumferential speed of the roll 32 and that of the wrapped roll 38. Thus, the corrugating medium 10 and the liner 36 fed along the circumference of the second corrugating roll 16 are brought into press contact by the tension with the second corrugating roll 16 to achieve full adhesion between the corrugating medium 10 and the liner 36 to form a single-faced corrugated fiberboard 101.

Besides, since the corrugating medium 10 and the liner 36 are brought into press contact with the second corrugating roll 16 over an area having a predetermined length in the web feeding direction, secured adhesion can be achieved between the corrugating medium 10 and the liner 36. Further, since the corrugating medium 10 is pressed strongly by the tension against the second corrugating roll 16, heat is efficiently transferred to the gluing portions of the corrugating medium 10 and the liner 36, also ensuring adhesion between them.

Meanwhile, since the wrapping area of the wrapped roll 38 over which the corrugating medium 10 and the liner 36 are to be wrapped is set depending on various production conditions including feeding speed, type, material, thickness, etc. of the corrugating medium 10 and the liner 36, tension can be securely applied by the wrapped roll 38 to the liner 36. More specifically, for example, when the liner 36 is of a slippery material, a long wrapping area is secured on the wrapped roll 38, and thus the rotational force of the roll 38 can be securely transmitted to the liner 36. Incidentally, when the liner 36 is of a nonslippery material, the rotational force of the roll 38 can be transmitted securely to the liner 36 even if a short wrapping area is secured on the wrapped roll 38. Further, when the corrugating medium 10 and the liner 36 have a large thickness, a long wrapping area is secured on the wrapped roll 38, and thus a great amount of heat can be transferred from the roll 38 to the gluing portions of the corrugating medium 10 and the liner 36, ensuring bonding between them.

As described above, according to the first embodiment, since the corrugating medium 10 and the liner 36 are bonded together with the aid of tension, to be generated by the difference between the circumferential speed of the roll 32 and that of the wrapped roll 38, which brings them into press contact with the second corrugating roll 16, the nip pressure of the roll 32 can be set minimum, and thus not only vibration and noises to be generated during formation of a single-faced corrugated fiberboard but also press marks to be formed on the liner of the single-faced corrugated fiberboard 101 can be substantially eliminated. Besides, since the corrugating medium 10 and the liner 36 are brought into press contact with the second corrugating roll 16 over an area having a predetermined length in the web feeding direction, glue-bonding between the corrugating medium 10 and the liner 36 can be securely achieved.

(Second Embodiment)

Figure 5:
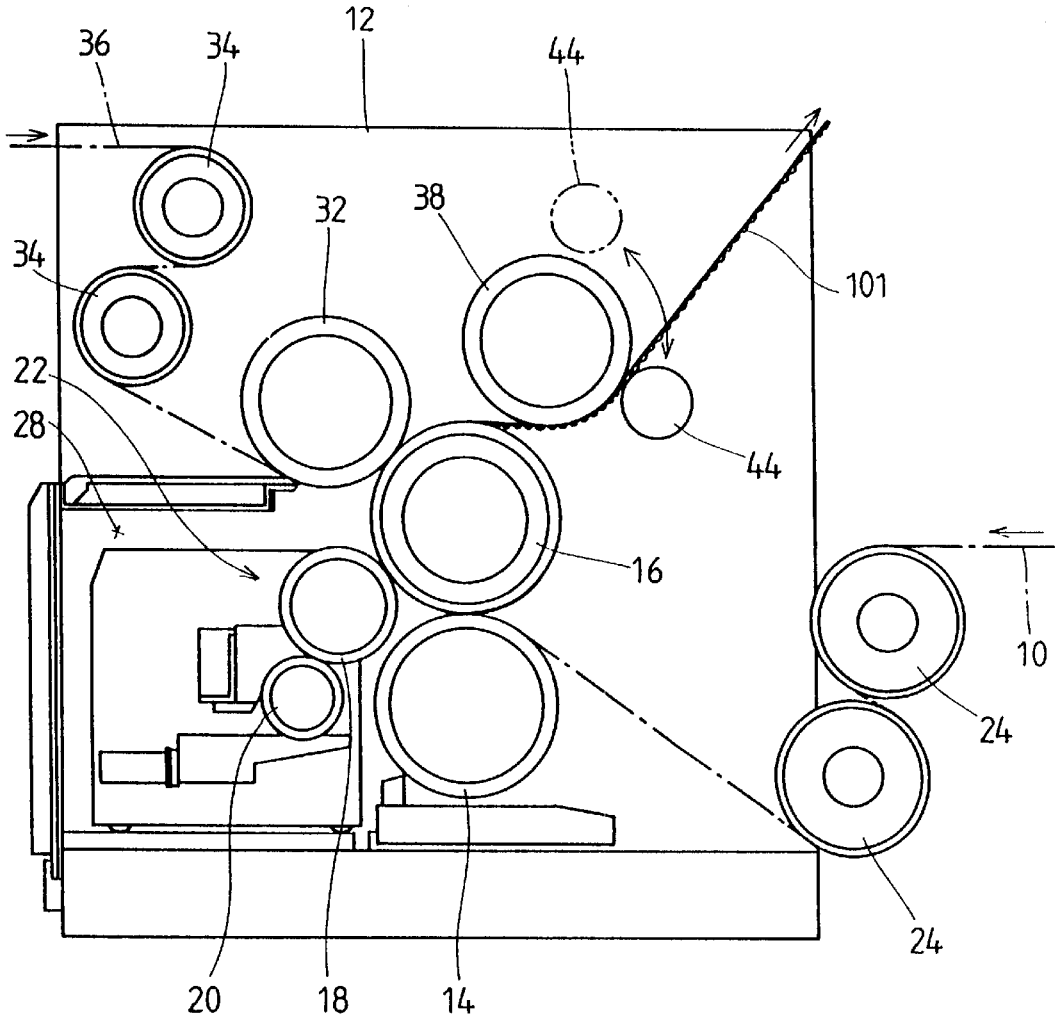
FIG. 5 is a schematic constitutional view of a single facer according to a second embodiment of the invention.

FIG. 5 shows schematically a constitution of a single facer according to a second embodiment of the invention. What is different from the first embodiment is the positional relationship of two corrugating rolls 14,16. Specifically, a second corrugating roll 16 is rotatably supported immediately above a first corrugating roll 14 rotatably supported by a pair of main frames 12, and wavy flutes of the roll 14 are designed to be engageable with those of the roll 16 via a corrugating medium 10. A gluing mechanism 22 housed in a pressure chamber 28 is located beside the first corrugating roll 14 and diagonally below the second corrugating roll 16. The corrugating medium 10 is fed from a web supply source (not shown) assumed to locate on the right side in FIG. 5 through a plurality of guide rolls 24 to the engagement zone defined between the first corrugating roll 14 and the second corrugating roll 16 to be corrugated as required when it is passed through this zone. The thus corrugated corrugating medium 10 is glued at the flute tips by the gluing mechanism 22 and then diverted upward along the circumference of the second corrugating roll 16. Meanwhile, the liner 36 is fed from a web supply source (not shown) assumed to locate on the left side in FIG. 5 via a plurality of preheaters 34 to the second corrugating roll 16 to be pasted with the glued flute tips of the corrugating medium 10 and fed as such upward.

A roll 32 and a wrapped roll 38 for bonding the corrugating medium 10 and the liner 36 together in cooperation with the second corrugating roll 16 are located on the opposite side of the second corrugating roll 16 from the first corrugating roll 14 to be spaced from each other in the circumferential direction of the second corrugating roll 16. More specifically, the roll 32 which can nip the corrugating medium 10 and the liner 36 in cooperation with the second corrugating roll 16 is located on the upstream side with respect to the direction of feeding the corrugating medium 10 and the liner 36; while the wrapped roll 38 which does not bring the corrugating medium 10 and the liner 36 into press contact with the second corrugating roll 16 is located on the downstream side with respect to the direction of feeding the corrugating medium 10 and the liner 36. The liner 36 passed through the preheaters 34 is adapted to be first fed along the circumference of the roll 32 to the bonding zone where it is pasted with the corrugating medium 10 and then to the wrapped roll 38.

While the roll 32 is adapted to be rotated at the same circumferential speed as that of the second corrugating roll 16, the wrapped roll 38 is adapted to be rotated at a circumferential speed a predetermined rate higher than that of the second corrugating roll 16, so that a necessary tension may be applied to the corrugating medium 10 and the liner 36 present between the roll 32 and the wrapped roll 38. More specifically, the corrugating medium 10 fed along the circumference of the second corrugating roll 16 and the liner 36 to be pasted therewith are nipped together between the roll 32 and the second corrugating roll 16 to undergo initial adhesion, and also the corrugating medium 10 and the liner 36 are designed to be brought into press contact with the second corrugating roll 16 under the pulling action of the wrapped roll 38 to achieve bonding between the corrugating medium 10 and the liner 36.

A wrapping roll 44 is rotatably disposed to oppose the wrapped roll 38 across the line of feeding the corrugating medium 10 and the liner 36 having undergone initial adhesion being fed along the wrapped roll 38. The position of the wrapping roll 44 is designed to be adjustable in the circumferential direction of the wrapped roll 38 by the same position adjusting mechanism 46 as in the first embodiment. An appropriate wrapping area over which the corrugating medium 10 and the liner 36 are wrapped is set on the wrapped roll 38 depending on various production conditions including feeding speed, type, material, thickness, etc. of the corrugating medium 10 and the liner 36, so that the rotational force (pulling action) of the roll 38 may be securely transmitted to the liner 36.

In this second embodiment again, since the corrugating medium 10 and the liner 36 can be brought into press contact with the second corrugating roll 16 over an area having a predetermined length in the web feeding direction by the tensile force acted by the wrapped roll 38, glue-bonding between the corrugating medium 10 and the liner 36 can be securely achieved. Further, vibration and noises to be generated during formation of single-faced corrugated fiberboard and press marks which can be formed on the liner can be eliminated like in the first embodiment.

(Modification)

Figure 6:
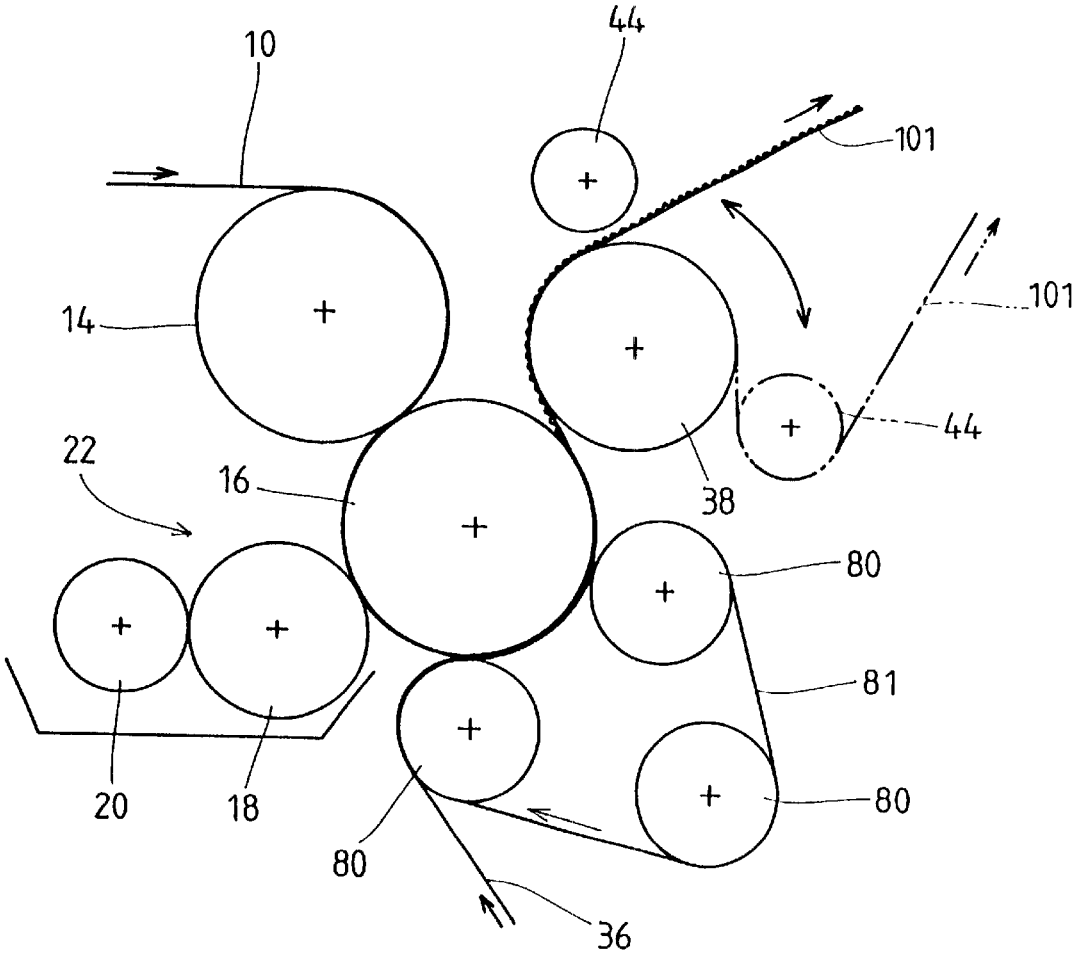
FIG. 6 is a schematic constitutional view of a variation of the introducing device employed in the single facer according to the first embodiment.

In the first and second embodiments described above, the roll 32 is employed as the introducing device. However, the present invention is not limited to such constitution. For example, as shown in FIG. 6, an endless belt 81 wrapped around a plurality (three in FIG. 6) of rolls 80 may be disposed adjacent to the second corrugating roll 16 to be able to run freely along these rolls 80, and the endless belt 81 is brought closer to the circumference of the second corrugating roll 16 to achieve initial adhesion between the corrugating medium 10 and the liner 36 passing through the gap between the roll 16 and the endless belt 81. When the endless belt 81 is employed in place of the roll 32, generation of greater vibration and greater noises can be controlled, and also press marks are prevented from being formed on the single-faced corrugated fiberboard 101. In addition, since insufficiency in the bonding to be achieved by the endless belt 81 only can be compensated by the pulling action of the wrapped roll 38, secured bonding can be achieved between the corrugating medium 10 and the liner 36. Incidentally, the endless belt 81 may be of a constitution where it is driven by the rotation of the second corrugating roll 16 or of a constitution where it is positively driven by an independent drive source and is basically adapted to run at the same speed as the circumferential speed of the second corrugating roll 16.

Figure 7:
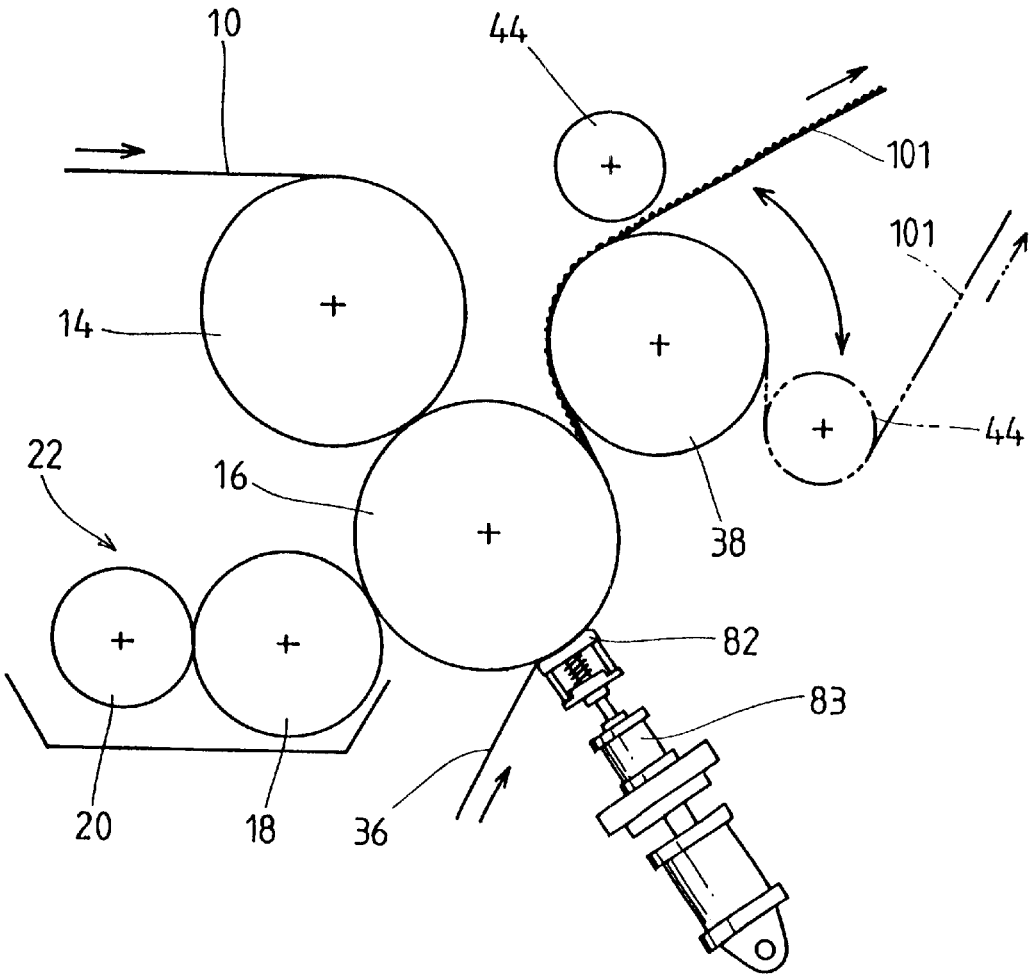
FIG. 7 is a schematic constitutional view of another variation of the introducing device employed in the single facer according to the first embodiment.

FIG. 7 shows a constitution where a pressing member 82 which can be brought into slide contact with the liner 36 is employed as the introducing device. The pressing member 82, which can be advanced or retracted in the radial direction of the second corrugating roll 16 by a cylinder 83, is located to oppose the second corrugating roll 16 across the line of feeding the corrugating medium 10 and the liner 36. The surface of the pressing member 82 opposing the second corrugating roll 16 is arcuate along the circumference of the roll 16, and the corrugating medium 10 and the liner 36 passing between this pressing member 82 and the second corrugating roll 16 are adapted to be nipped together to achieve initial adhesion therebetween. In the case where such pressing member 82 is employed, since the speed of the liner 36 at the site where initial adhesion with the corrugating medium 10 is to be achieved between the pressing member 82 and the second corrugating roll 16 is the same as the circumferential speed of the second corrugating roll 16, tension can be applied by the wrapped roll 38 to the corrugating medium 10 and the liner 36 present between the pressing member 82 and the wrapped roll 38. More specifically, by using the pressing member 82 in combination with the wrapped roll 38, the nip pressure of the pressing member 82 can be set at a small level, and thus generation of great vibration and great noises can be controlled and press marks are prevented from being formed on the single-faced corrugated fiberboard 101. It should be noted here that while it is recommended, as the constitution of the pressing member 82, to employ a plurality of pressing members 82 arranged in the axial direction of the second corrugating roll 16, it is also possible to employ a constitution in which a single pressing member 82 is disposed to be parallel with the axis of the second corrugating roll 16.

While the constitutions shown in FIGS. 6 and 7 are described with respect to the case where the first corrugating roll 14 and the second corrugating roll 16 are arranged like in the first embodiment shown in FIG. 1, these rolls 14,16 may be of course arranged like in the second embodiment shown in FIG. 5. Incidentally, as the introducing device, it may be two or more rolls arranged in the circumferential direction of the second corrugating roll or may be a combination of a roll and a pressing member or of an endless belt and a pressing member. However, when the combination of an endless belt and a pressing member is employed, there may be suitably employed a constitution where the pressing member is located on the other side of the endless belt from the second corrugating roll to press the endless belt by the pressing member via the corrugating medium and the liner against the second corrugating roll.

It should be noted that in the first and second embodiments described above, the wrapped roll is adapted to be driven to rotate by an independent variable motor, but the wrapped roll may be connected via a mechanism such as a variable transmission mechanism to the second corrugating roll so as to be rotationally driven by the second corrugating roll. Meanwhile, the wrapping roll may be a corrugating roll having flutes of the same wave form as that of the second corrugating roll, and it is also possible to be driven positively at the same circumferential speed as that of the wrapped roll.

(Third Embodiment)

Figure 8:
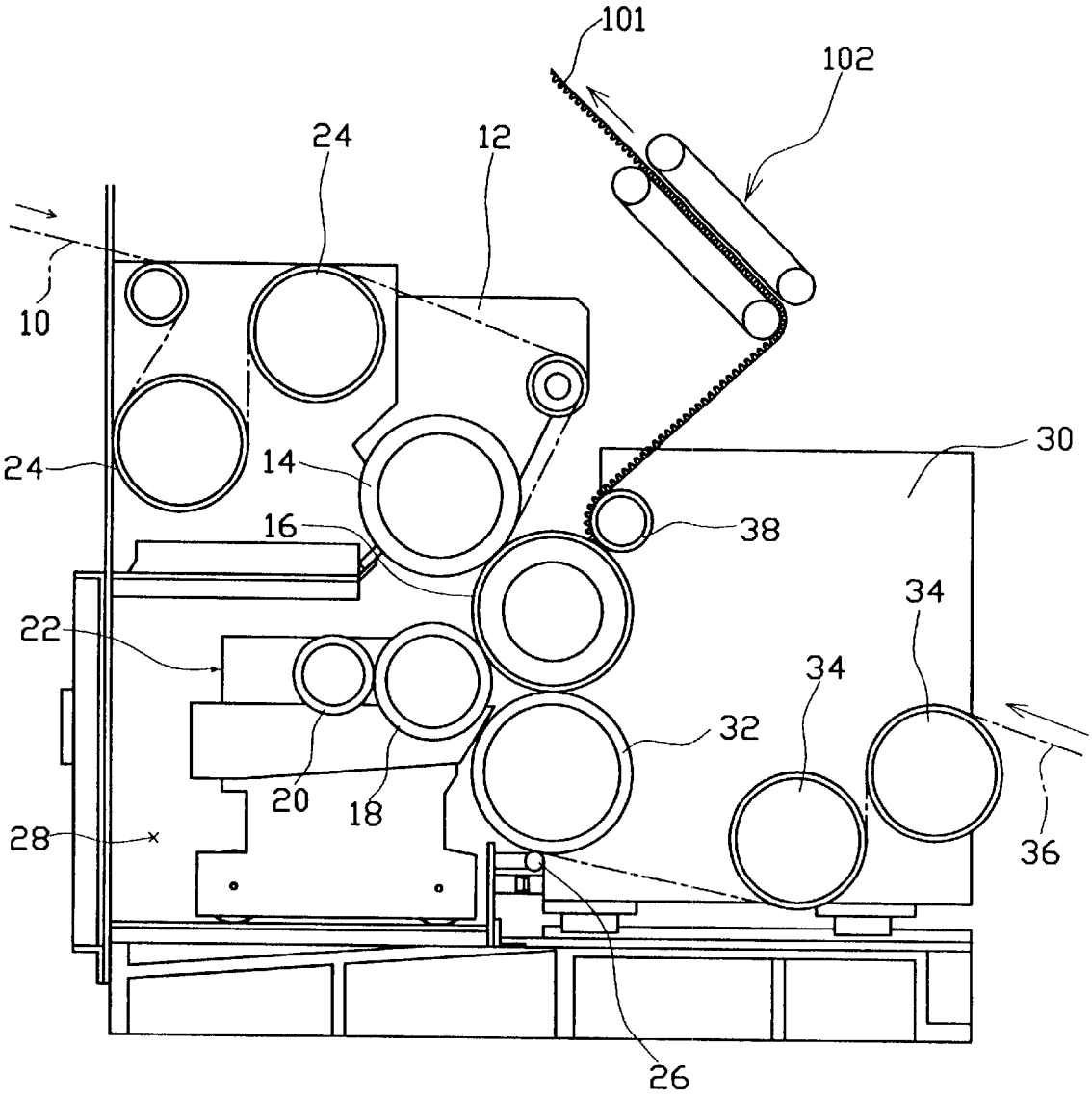
FIG. 8 is a schematic constitutional view of a single facer according to a third embodiment of the invention.

FIG. 8 shows a schematic constitution of the single facer according to a third embodiment of the invention. Since the basic constitution is the same as that of the first embodiment, only different portions will be described.

A roll 32, as the introducing device for achieving bonding of the corrugating medium 10 and the liner 36 in cooperation with the second corrugating roll 16, and a wrapped roll 38 are disposed to be spaced from each other in the circumferential direction of the second corrugating roll 16 on the opposite side of the second corrugating roll 16 from the first corrugating roll 14. More specifically, the roll 32 having a constitution where it can adjust the gap G with the opposing portion of the second corrugating roll 16 via a gap adjusting mechanism 100 (to be described later) is located on the upstream side with respect to the line of feeding the corrugating medium 10 and the liner 36, and the liner 36 is adapted to be guided by the roll 32 toward that opposing portion of the second corrugating roll 16. Meanwhile, the wrapped roll 38 is located, so as not to bring the corrugating medium 10 and the liner 36 into press contact with the second corrugating roll 16, on the downstream side of the roll 32 with respect to the web feeding line. This wrapped roll 38 functions to wrap the corrugating medium 10 and the liner 36 present between the upstream-side roll 32 and the roll 38 over a predetermined length around the second corrugating roll 16 so as to apply heat from the second corrugating roll 16 to the gluing portions of the corrugating medium 10 and the liner 36 for a predetermined time.

The roll 32 is adapted to be driven at the same circumferential speed as that of the second corrugating roll 16 in the same manner as described above. Meanwhile, the wrapped roll 38 is rotatably supported between the sub frames 30 and is designed to be driven by the single-faced corrugated fiberboard 101 wrapped around the circumference of the roll 38. Incidentally, the wrapped roll 38 may be a simple guide roller to which high-temperature steam is not distributed.

A take-up conveyor 102 as a towing device for nipping the single-faced corrugated fiberboard 101 formed by pasting the corrugating medium 10 and the liner 36 together to pull it downstream is disposed on the downstream side of the wrapped roll 38, as shown in FIG. 8. This take-up conveyor 102 is adapted to be driven to run at a speed higher than the circumferential speed of the second corrugating roll 16 (roll 32 and the wrapped roll 38) to apply a necessary tension to the corrugating medium 10 and the liner 36 present between the roll 32 and the wrapped roll 38. More specifically, the corrugating medium 10 fed along the circumference of the second corrugating roll 16 and the liner 36 to be pasted therewith are designed to be brought into press contact with the second corrugating roll 16 by the pulling action induced by the towing force of the take-up conveyor 102.

Figure 9:
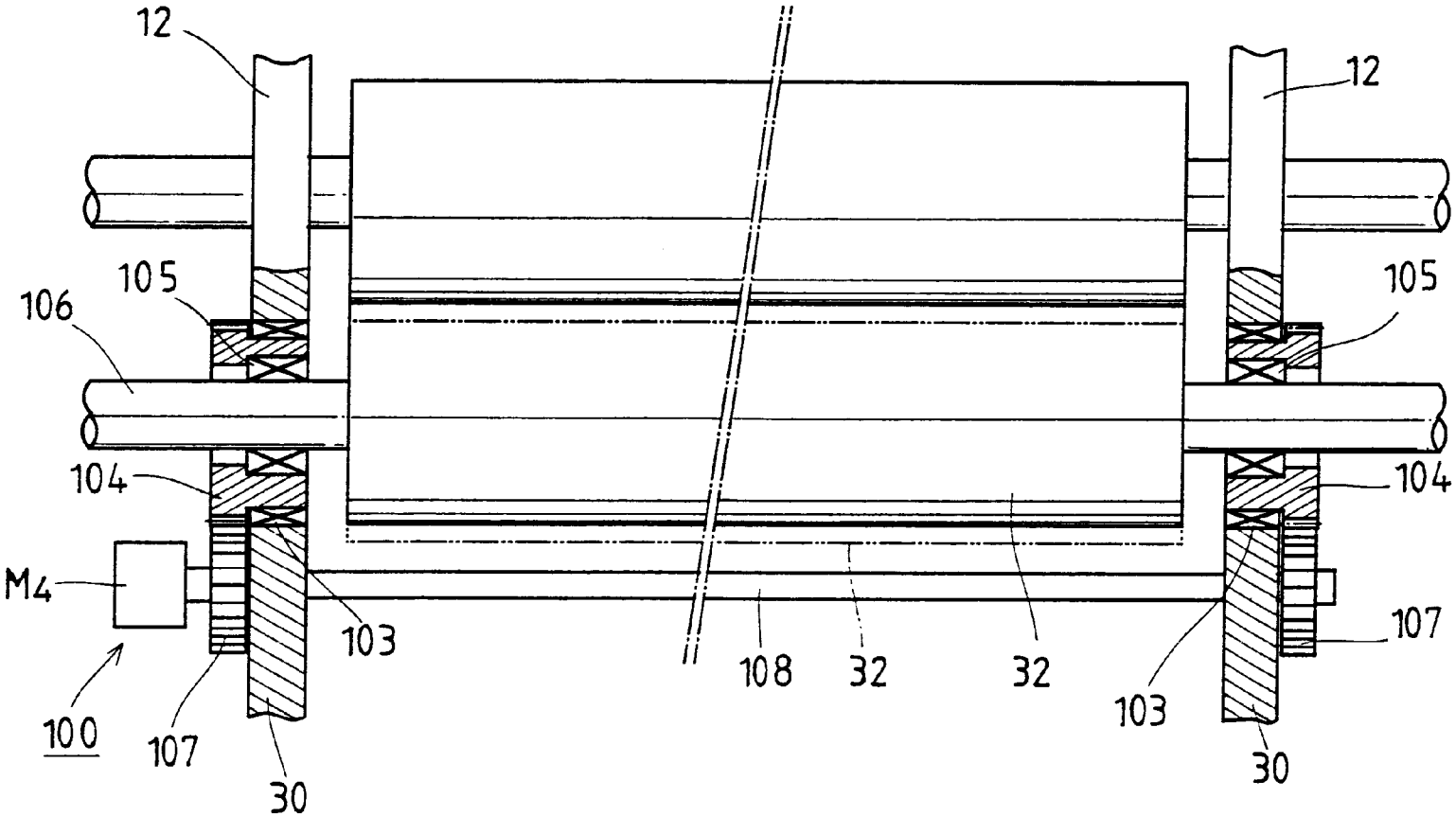
FIG. 9 is a schematic constitutional view of the gap adjusting mechanism for the roll in the third embodiment.

The gap adjusting mechanism 100 for the roll 32 has a pair of eccentric gears 104 pivotally supported via bearings 103 respectively on the sub frames 30, as shown in FIG. 9, and the rotary shaft 106 of the roll 32 is rotatably supported via bearings 105 by the eccentric gears 104, respectively. A pair of adjust gears 107, which are engaged with the eccentric gears 104, are rotatably supported by the sub frames 30, respectively, and are designed to be turned integrally via a connecting shaft 108. An adjust motor M4 is connected to the adjust gear 107 supported on the drive-side (left side in FIG. 9) sub frame 30, and the roll 32 is adapted to be moved closer to or farther from the second corrugating roll 16 by driving the motor M4 to turn the eccentric gears 104 via the adjust gears 107.

Figure 10:
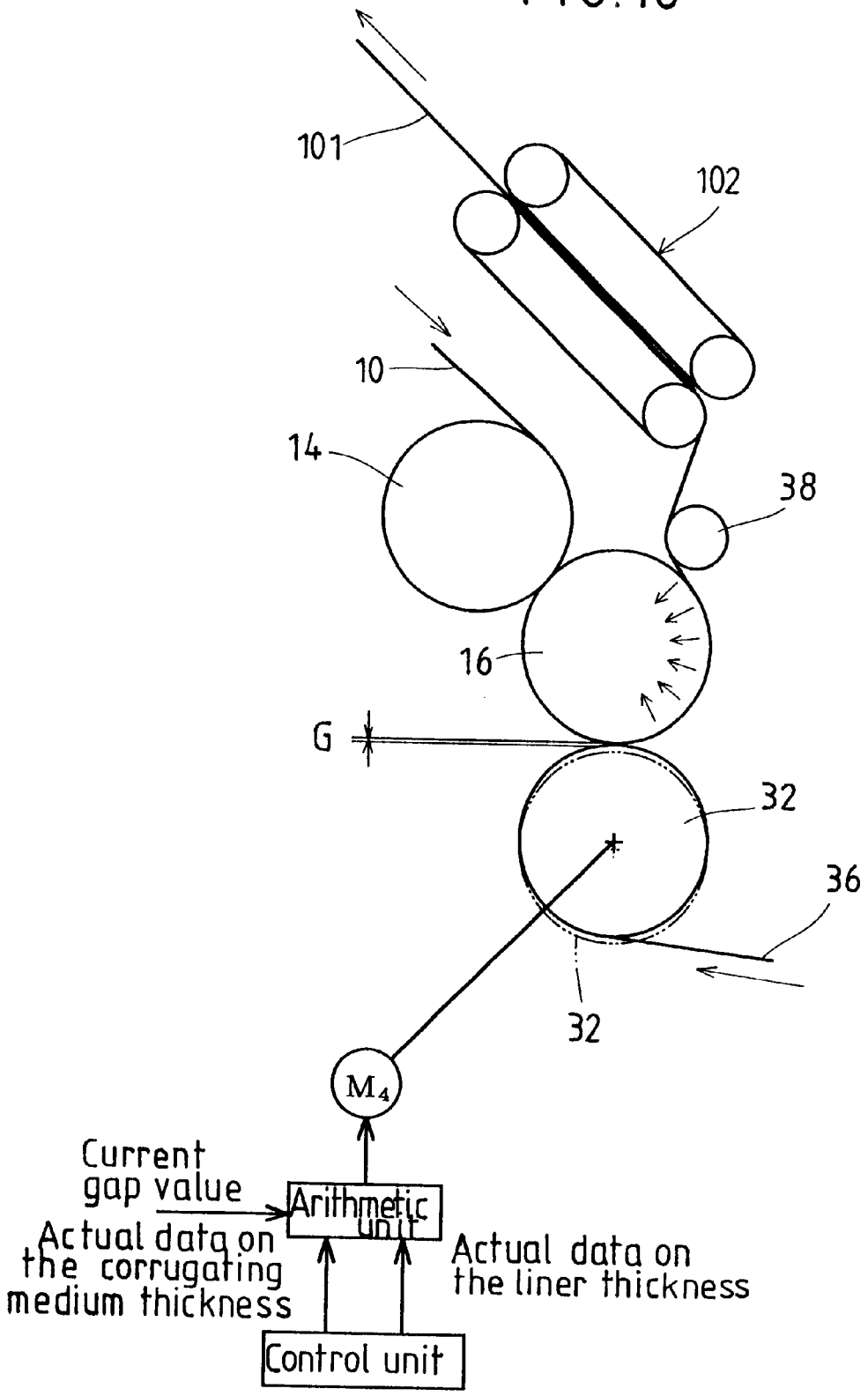
FIG. 10 is a block diagram showing the control system for the gap adjusting mechanism in the single facer according to the third embodiment.

As shown in FIG. 10, an arithmetic unit 110, to which actual data on the thickness N1 of the corrugating medium 10 and actual data on the thickness N2 of the liner 36 are inputted from a control unit 109 is connected to the adjust motor M4. In the arithmetic unit 110, a control signal corresponding to the total thickness N of the actual data of the thickness N1 of the corrugating medium 10 plus the actual data on the thickness N2 of the liner 36 is designed to be given to the adjust motor M4. Thus, the roll 32 is moved closer to or farther from the second corrugating roll 16 to adjust the gap G between these rolls 32 and 16 to a value corresponding to the total thickness N.

It should be noted here that since the corrugating medium 10 and the liner 36 are adapted to be bonded securely together in the single facer according to the third embodiment by wrapping the corrugating medium 10 and the liner 36 present between the roll 32 and the wrapped roll 38 over a predetermined length around the second corrugating roll 16, no pressure may be acted by the roll 32 upon the corrugating medium 10 and the liner 36. In other words, the gap G between the second corrugating roll 16 and the roll 32 is set not to be smaller than the total thickness N ($G \geqq N$) of the thickness N1 of the corrugating medium 10 plus the thickness N2 of the liner 36, so that no pressure may be applied by the roll 32 to the corrugating medium 10 and the liner 36 guided to the zone where the second corrugating roll 16 and the roll 32 oppose each other. When the thickness N1 of the corrugating medium 10 and the thickness N2 of the liner 36 are changed due to an order change, actual data on the thickness to be inputted anew is subjected to relational operation with the current value of gap G so that the gap G between the second corrugating roll 16 and the roll 32 may be set to an appropriate level.

Figure 11:
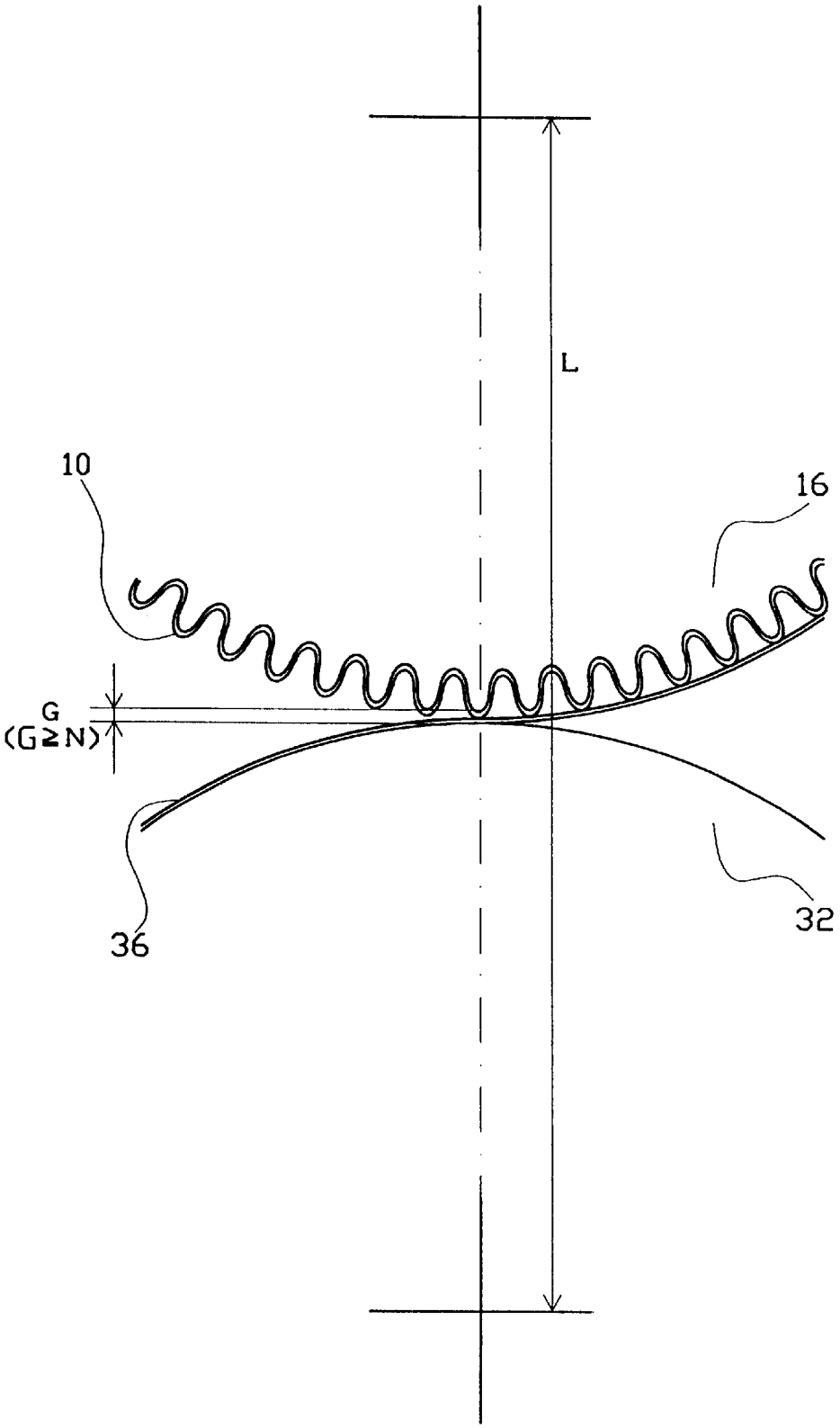
FIG. 11 is an explanatory view showing the relationship between the second corrugating roll and the roll in the third embodiment.

Further, after adjustment of the gap G, the position of the roll 32 is fixed (capable of rotation) there such that the axis-to-axis distance L between the second corrugating roll 16 and the roll 32 may not be changed during operation (see FIG. 11). Thus, vibration and noises or formation of press marks on the liner to be caused by the fluctuation in the axis-to-axis distance L between the second corrugating roll 16 and the roll 32 can be securely prevented from occurring.

(Actions of the Third Embodiment)

Next, actions of the single facer according to the third embodiment will be described. In producing a single-faced corrugated fiberboard 101, the gap G between the second corrugating roll 16 and the roll 32 is adjusted not to be smaller than the total thickness N of the thickness N1 of the corrugating medium 10 plus the thickness N2 of the liner 36 by moving the roll 32 with the aid of the gap adjusting mechanism 100. Incidentally, since the relationship between the gap G and the total thickness N is expressed by $G \geqq N$ (see FIG. 11), as described above, no pressing force is acted by the roll 32 against the corrugating medium 10 and the liner 36. Further, after the gap G is adjusted, the roll 32 is positioned there.

The first corrugating roll 14 and the second corrugating roll 16 are rotationally driven, and also the take-up conveyor 102 is driven to run at a speed higher than the circumferential speed of the second corrugating roll 16. In this state, the corrugating medium 10 supplied from the web supply source via the guide rolls 24 to the engagement zone between the first corrugating roll 14 and the second corrugating roll 16 is corrugated as required when it is passed through that zone. The thus corrugated corrugating medium 10 is glued at the flute tips by the gluing mechanism 22 and then diverted upward along the circumference of the second corrugating roll 16 (see FIG. 8).

Meanwhile, the liner 36 supplied from the web supply source via the preheaters 34 is fed to the gap between the second corrugating roll 16 and the roll 32. This liner 36 is fed together with the corrugating medium 10 along the circumference of the second corrugating roll 16 to the location of the wrapped roll 38. In this instance, since the take-up conveyor 102 is driven to rotate at a circumferential speed higher than that of the second corrugating roll 16 or the roll 32, the corrugating medium 10 and the liner 36 passed the roll 32 are pulled toward the downstream side by the towing force of the take-up conveyor 102. Thus, the corrugating medium 10 and the liner 36 fed along the circumference of the second corrugating roll 16 are brought into press contact with the second corrugating roll 16 by the tension thus generated, as shown in FIG. 10. Further, since the corrugating medium 10 and the liner 36 are wrapped around the second corrugating roll 16 over a predetermined length with respect to the web feeding direction, heat can be transferred from the roll 16 for a predetermined time. More specifically, bonding between the corrugating medium 10 and the liner 36 can be securely achieved by the action that the corrugating medium 10 and the liner 36 are brought into press contact with the circumference of the second corrugating roll 16 over a predetermined length and by the heat transferred from the second corrugating roll 16 to the gluing portions.

As described above, the roll 32 does not press the corrugating medium 10 and the liner 36 against the second corrugating roll 16, and further the position of the roll 32 is fixed during operation such that the axis-to-axis distance L between the second corrugating roll 16 and the roll 32 may not be changed. Accordingly, there is neither generation of vibration and noises during formation of single-faced corrugated fiberboards nor formation of press marks on the liner of the single-faced corrugated fiberboard 101.

(Fourth Embodiment)

Figure 12:
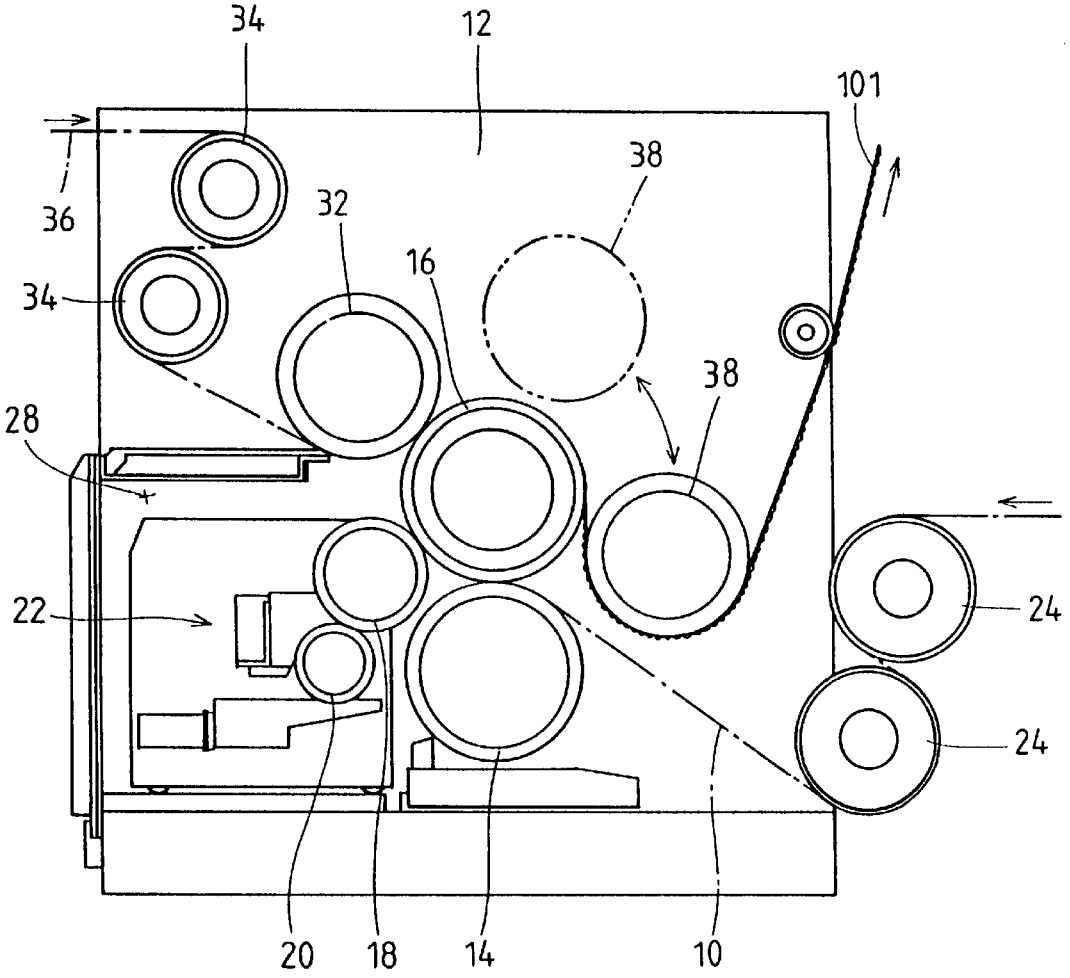
FIG. 12 is a schematic constitutional view of a single facer according to a fourth embodiment of the invention.

FIG. 12 shows a schematic constitution of the single facer according to a fourth embodiment of the invention. Since the basic constitution of this embodiment is the same as that of the second embodiment, only different parts will be described.

A roll 32 is disposed rotatably above the second corrugating roll 16 to rotate at the same circumferential speed as that of the roll 16. This roll 32 functions to bring the corrugating medium 10 fed along the circumference of the second corrugating roll 16 and the liner 36 to be pasted therewith against the second corrugating roll 16 with such a small nip pressure as to form no press marks on the liner 36. Meanwhile, a wrapped roll 38, which is disposed to be spaced from the roll 32 on the downstream side with respect to the direction of feeding the corrugating medium 10 and is rotated at a circumferential speed higher than that of the second corrugating roll 16, is positioned such that it may not bring the corrugating medium 10 and the liner 36 into press contact with the second corrugating roll 16. Thus, the corrugating medium 10 and the liner 36 present between the roll 32 and the wrapped roll 38 is pressed against the circumference of the second corrugating roll 16 by the tension generated by the difference between the circumferential speed of the roll 32 and that of the wrapped roll 38 to achieve bonding between the corrugating medium 10 and the liner 36.

Figure 14:
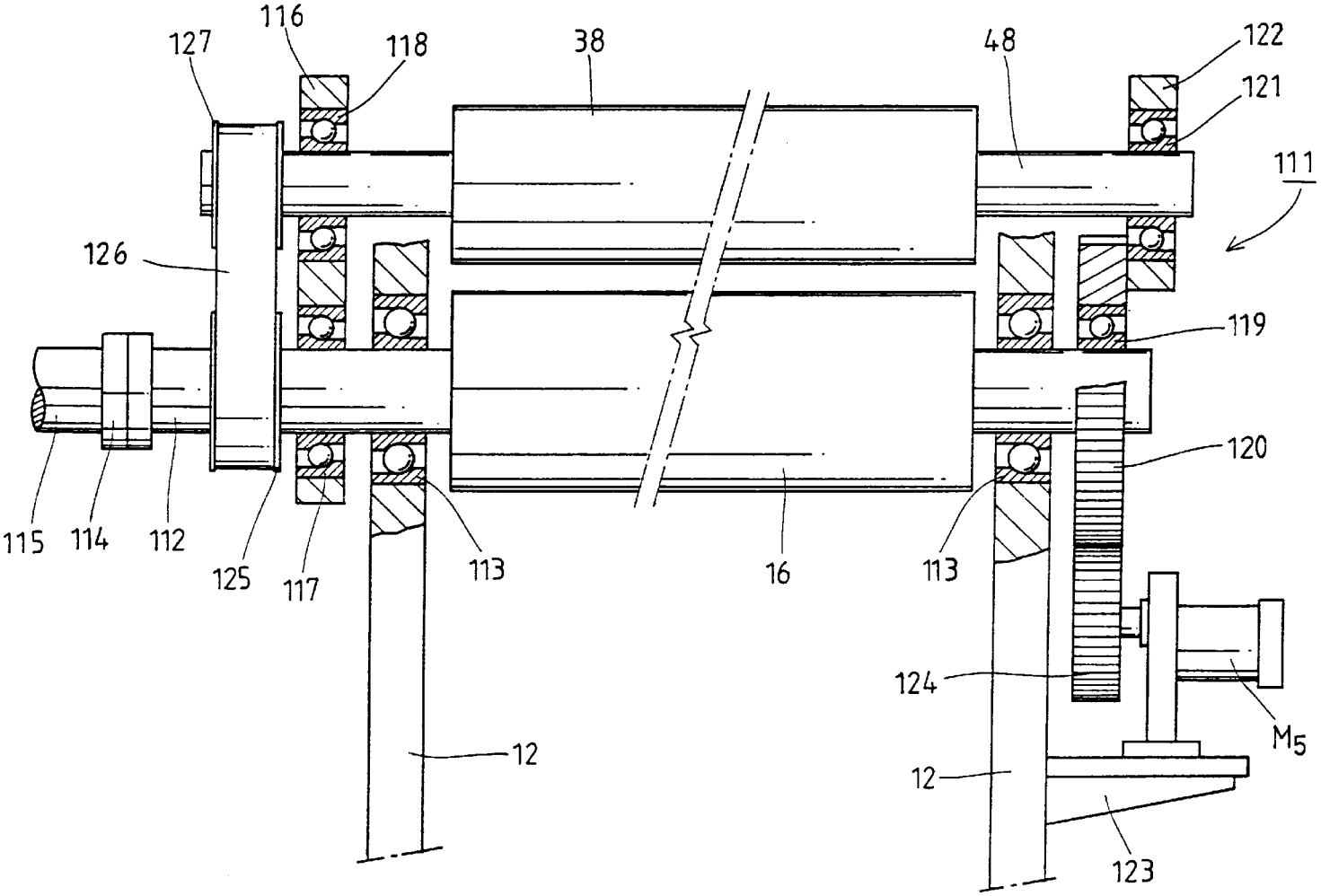
FIG. 14 is a schematic constitutional view of the position adjusting mechanism for the wrapped roll in the fourth embodiment.

The wrapped roll 38 is adapted to be able to move in the circumferential direction. of the second corrugating roll 16 with the aid of a position adjusting mechanism 111 so that the wrapping area on the second corrugating roll 16 over which the corrugating medium 10 and the liner 36 are wrapped may be changed depending on various production conditions including feeding speed, type, material, thickness, etc. of the corrugating medium 10 and the liner 36. As the position adjusting mechanism 111, there may be employed one having the same basic constitution as that of the position adjusting mechanism 46 for adjusting the position of the wrapping roll 44 relative to the wrapped roll 38 referred to in the first embodiment. More specifically, as shown in FIG. 14, the rotary shaft 112 of the second corrugating roll 16 is rotatably supported via a pair of bearings 113 on the main frames 12, and a drive shaft 115 connected to the motor M1 is connected via a coupling 114 to the end portion of the rotary shaft 112 protruding outward from the drive-side main frame 12, so that the second corrugating roll 16 may be driven to rotate at a circumferential speed corresponding to the speed of feeding the corrugating medium 10 and the liner 36 (line speed). A drive-side pivotal frame 116 is pivotally supported at one end portion via a bearing 117 on the rotary shaft 112 of the second corrugating roll 16 at the end portion protruding outward from the drive-side main frame 12; whereas the rotary shaft 48 of the wrapped roll 38 is pivotally supported via a bearing 118 on the other end portion of this drive-side pivotal frame 116. Meanwhile, a large-diameter gear 120 is rotatably supported via a bearing 119 on the rotary shaft 112 of the second corrugating roll 16 at the end portion protruding outward from the operation-side main frame 12. An operation-side pivotal frame 122 rotatably supported via a bearing 121 on the rotary shaft 48 of the wrapped roll 38 at the end portion protruding outward on the operation side is fixed to this large-diameter gear 120, so that the operation-side pivotal frame 122 may turn with the rotation of the large-diameter gear 120. More specifically, the wrapped roll 38 is located a predetermined distance away from the second corrugating roll 16 to be parallel with each other via the drive-side pivotal frame 116, the operation-side pivotal frame 122 and the gear 120, and the wrapped roll 38 is also designed to be moved in the circumferential direction of the second corrugating roll 16 with the predetermined distance being kept from the roll 16.

Figure 13:
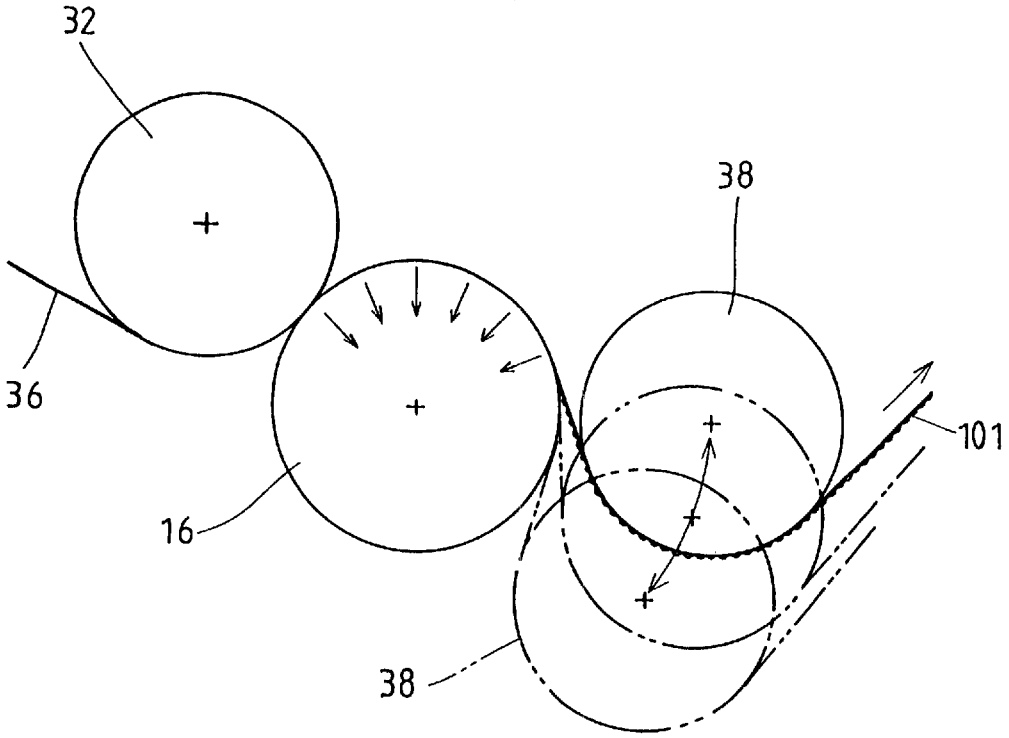
FIG. 13 is an explanatory view showing the relationship between the roll and the wrapped roll in the fourth embodiment.

An adjust motor M5 which rotates in the positive and negative directions is disposed via a bracket 123 on the operation-side main frame 12, and a gear 124 attached to the output shaft of the motor M5 is engaged with the large-diameter gear 120. More specifically, when the adjust motor M5 is driven to rotate in the positive or negative direction, the wrapped roll 38 is moved in the circumferential direction of the second corrugating roll 16, as shown in FIG. 13, with the rotation of the large-diameter gear 120. Thus, the distance between the roll 32 and the wrapped roll 38 is changed, and the wrapping area of the second corrugating roll 16 over which the corrugating medium 10 and the liner 36 present between the roll 32 and the wrapped roll 38 are wrapped can be changed.

A belt pulley 125 is fitted on the rotary shaft 112 of the second corrugating roll 16 on the drive side, and a belt 126 which is wrapped around the belt pulley 125 is also wrapped around another belt pulley 127 fitted on the rotary shaft 48 of the wrapped roll 38. The rotary shaft 48 of the wrapped roll 38 and the belt pulley 127 are connected via a differential gear (not shown) so that the wrapped roll 38 may be rotated at a circumferential speed a predetermined rate higher than that of the second corrugating roll 16. Incidentally, it is also possible to rotate the wrapped roll 38 by allowing the gear attached to the rotary shaft 48 of the wrapped roll 38 to engage with the gear attached to the rotary shaft 112 of the second corrugating roll 16. In this case, the gear ratio of these gears must be set such that the circumferential speed of the wrapped roll 38 may be higher than that of the second corrugating roll 16.

(Actions of the Fourth Embodiment)

Actions of the single facer according to the fourth embodiment will be described. In producing a single-faced corrugated fiberboard 101, the roll 32 is moved closer to the second corrugating roll 16 so as to be able to bring the corrugating medium 10 and the liner 36 fed along the circumference of the second corrugating roll 16 into press contact with the surface of the roll 16. The nip pressure of the roll 32 in this instance is set to such a small level that it can achieve initial adhesion between the corrugating medium 10 and the liner 36 and that no press mark is formed on the liner 36. Further, the wrapped roll 38 is moved in the circumferential direction of the second corrugating roll 16 via the position adjusting mechanism 111 so as to provide an appropriate wrapping area depending on various production conditions including feeding speed, type, material, thickness, etc. of the corrugating medium 10 and the liner 36.

The first corrugating roll 14 and the second corrugating roll 16 are rotationally driven, and also the wrapped roll 38 is driven to rotate at a circumferential speed higher than that of the second corrugating roll 16 by the power transmitted from the second corrugating roll 16 via the belt 126. In this state, the corrugating medium 10 supplied from the web supply source via the guide rolls 24 to the engagement zone between the first corrugating roll 14 and the second corrugating roll 16 is corrugated as required when it is passed through that zone. The thus corrugated corrugating medium 10 is glued at the flute tips by the gluing mechanism 22 and then diverted upward on the circumference of the second corrugating roll 16 (see FIG. 12).

Meanwhile, the liner 36 supplied from the web supply source via the preheaters 28 is fed to the bonding zone where the second corrugating roll 16 and the roll 32 are bonded together. This liner 36 is pressed against the flute tips of the corrugating medium 10 between the roll 32 and the second corrugating roll 16 to achieve initial adhesion between them. Since a small nip pressure is set for the roll 32, press marks are scarcely formed on the liner in achieving the initial adhesion of the corrugating medium 10 and the liner 36. Incidentally, the roll 32 is driven by the second corrugating roll 16 brought into press contact therewith via the corrugating medium 10 and the liner 36 at the same circumferential speed as that of the second corrugating roll 16.

The corrugating medium 10 and the liner 36 having been nipped between the second corrugating roll 16 and the roll 32 to undergo initial adhesion is fed along the circumference of the second corrugating roll 16 to the location of the wrapped roll 38. In this instance, the circumferential speed of the wrapped roll 38 is adapted to be higher than that of the second corrugating roll 16 or the roll 32, the corrugating medium 10 and the liner 36 passed the roll 32 are pulled toward the wrapped roll 38 by the difference between the circumferential speed of the roll 32 and that of the wrapped roll 38. Thus, the corrugating medium 10 and the liner 36 fed along the circumference of the second corrugating roll 16 are brought into press contact with the second corrugating roll 16 by the tension thus generated, as shown in FIG. 13. Besides, since the corrugating medium 10 and the liner 36 are brought into press contact with the second corrugating roll 16 over the wrapping area which is secured in the longitudinal direction with respect to the web feeding direction, gelation of the starchy glue is accelerated by the heat transferred from the roll 16 to achieve secured bonding between the corrugating medium 10 and the liner 36.

As described above, in the fourth embodiment, since the corrugating medium 10 and the liner 36 are brought into press contact with the second corrugating roll 16 over a predetermined length along the circumference thereof by the tension generated by the difference between the circumferential speed of the roll 32 and that of the wrapped roll 38, and since heat is transferred from the roll 16 over a predetermined time to achieve secured bonding between the corrugating medium 10 and the liner 36, the nip pressure of the roll 32 can be set to a minimum level as required for achieving initial adhesion. Accordingly, not only vibration and noises to be generated during formation of a single-faced corrugated fiberboard but also press marks to be formed on the liner of the single-faced corrugated fiberboard can be eliminated.

(Variation of the Fourth Embodiment)

Figure 15:
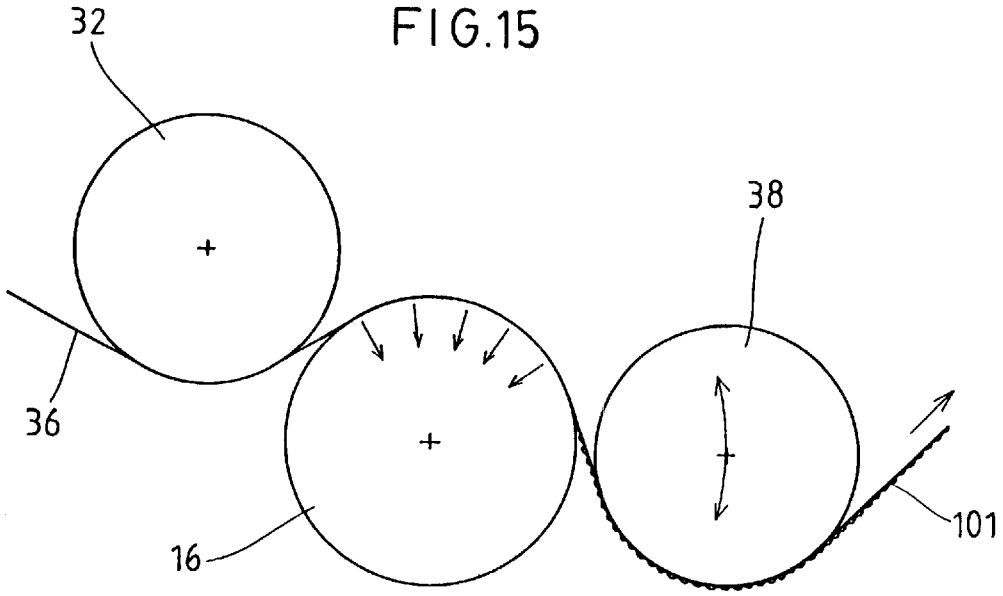
FIG. 15 is an explanatory view showing a variation of the position at which the roll is disposed in the single facer of the fourth embodiment.

In the fourth embodiment described above, while the wrapped roll 38 is rotationally driven indirectly by a mechanism such as a belt connected to the second corrugating roll 16, it may be adapted to be controlled independently by a variable motor M2 shown in FIG. 3. In the fourth embodiment described above, while initial adhesion between the corrugating medium 10 and the liner 36 is achieved by bringing the roll 32 into press contact with the second corrugating roll 16 via the corrugating medium 10 and the liner 36 with a necessary nip pressure, the roll 32 may be designed not to give nip pressure like in the third embodiment. For example, as shown in FIG. 15, the roll 32 may be arranged to be spaced from the second corrugating roll 16 to achieve bonding between the corrugating medium 10 and the liner 36 only by the tension to be generated by the wrapped roll 38 and the heat to be transferred from the second corrugating roll 16. In this case, since the roll 32 is not pressed against the second corrugating roll 16 like in the third embodiment, there is no liability of causing the hammering phenomenon or forming press marks on the liner of the single-faced corrugated fiberboard 101.

(Fifth Embodiment)

Figure 16:
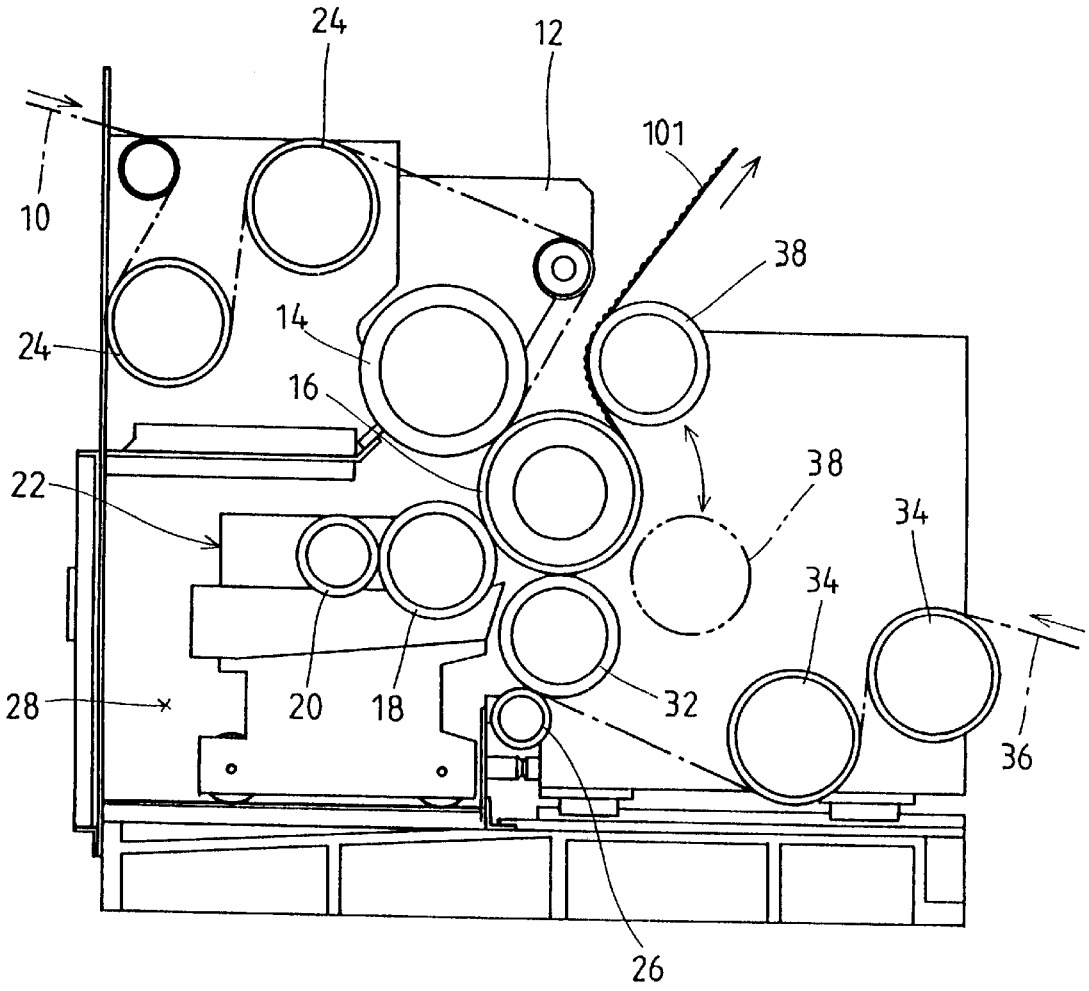
FIG. 16 is a schematic constitutional view of a single facer according to a fifth embodiment of the invention.

FIG. 16 shows a schematic constitution of the single facer according to a fifth embodiment of the invention, in which the positional relationship between the two corrugating rolls 14,16 is the same as in the third embodiment, but the nip pressure of the roll 32 is set to a minimum value, and the corrugating medium 10 and the liner 36 present between the wrapped roll 38 and the roll 32 are adapted to be wrapped around the second corrugating roll 16 and to be brought into press contact therewith by the tension applied by the wrapped roll 38.

More specifically, the roll 32, which can nip the corrugating medium 10 and the liner 36 in cooperation with the second corrugating roll 16, is disposed immediately below the second corrugating roll 16, and the roll 32 is designed to be driven to rotate at the same circumferential speed as that of the second corrugating roll 16. Meanwhile, the wrapped roll 38 is disposed on the downstream side of the roll 32 with respect to the web feeding direction in such a positional relationship that it may not bring the corrugating medium 10 and the liner 36 into press contact with the second corrugating roll 16, and the roll 38 is designed to be rotated at a circumferential speed higher than that of the second corrugating roll 16. In the fifth embodiment again, the corrugating medium 10 fed along the circumference of the second corrugating roll 16 and the liner 36 to be pasted therewith are designed to be nipped first between the roll 32 and the second corrugating roll 16 to achieve initial adhesion and also to be brought into press contact with the second corrugating roll 16 over a predetermined length by the pulling action of the wrapped roll 38.

In the fifth embodiment, since the corrugating medium 10 and the liner 36 are brought into press contact with the second corrugating roll 16 over the wrapping area set to a necessary length in the web feeding direction by the tension applied by the wrapped roll 38, and since heat is applied by the roll 16 over a necessary time, secured glue-bonding can be achieved between the corrugating medium 10 and the liner 36. Further, vibration and noises during formation of the single-faced corrugated fiberboard and formation of press marks on the liner of the single-faced corrugated fiberboard 101 can be eliminated like in the fourth embodiment.

Incidentally, the position of the wrapped roll 38 in the fifth embodiment is designed to be adjustable in the circumferential direction of the second corrugating roll 16 via the same position adjusting mechanism 111 as in the fourth embodiment so that an appropriate wrapping area can be secured depending on various production conditions including feeding speed, type, material, thickness, etc. of the corrugating medium 10 and the liner 36. Further, the variation of the fourth embodiment shown in FIG. 15 can be applied to the fifth embodiment.

(Modifications)

In any of the first to fifth embodiments described above, there may be employed, as the mechanism for retaining the corrugating medium on the circumference of the second corrugating roll, there may be employed a constitution where the second corrugating roll is allowed to have through holes formed in circumferential grooves defined thereon and to assume a negative pressure inside so as to attract the corrugating medium on the circumference of the second corrugating roll by the suction force to be acted through the through holes. Meanwhile, in any of the foregoing embodiments, heat is designed to be applied to the corrugating medium and the liner by the second corrugating roll. However, it is possible to achieve bonding between the corrugating medium and the liner by the pressing force generated by the pulling action of the wrapped roll or take-up conveyor, provided that no high-temperature steam is distributed into the second corrugating roll.

In the single facer having a wrapping roll 44 like in the first and second embodiments, it is possible to arrange the roll 32 with respect to the second corrugating roll 16 such that the roll 32 may not press the corrugating medium 10 and the liner 36 against the second corrugating roll 16 as shown in the third embodiment. Meanwhile, the position of the wrapped roll 38 according to the third embodiment may be designed to be adjustable in the circumferential direction of the second corrugating roll 16 via the position adjusting mechanism, 111 as employed in the fourth embodiment so as to change the wrapping area on the second corrugating roll 16 on which the corrugating medium 10 and the liner 36 are wrapped depending on various production conditions including feeding speed, type, material, thickness, etc. of the corrugating medium 10 and, the liner 36. Further, in any of the third to fifth embodiments, the roll as the introducing device may be replaced with the endless belt 81 shown in FIG. 6 or the pressing member 82 shown in FIG. 7. Even when the endless belt 81 or the pressing member 82 is disposed with respect to the second corrugating roll 16 so as to apply minimum nip pressure to the corrugating medium 10 and the liner 36 or when it is disposed so as not to apply pressure thereto, generation of vibration and noises or formation of press marks on the liner of the single-faced corrugated fiberboard 101 can be eliminated.

What is claimed is:

1. A single facer, comprising a first corrugating roll having wavy flutes formed on the circumference;

a second corrugating roll having wavy flutes formed on the circumference to be engageable with the flutes of the first corrugating roll for forming a corrugation on a corrugating medium to be passed between the two rolls;

a gluing mechanism for gluing flute tips of the corrugated corrugating medium;

introducing means for feeding a liner disposed opposite the second corrugating roll in a line of feeding the corrugating medium and a liner;

said introducing means being disposed relative to the second corrugating roll to press the corrugating medium and the liner with a predetermined small nip pressure so that substantially no press marks are formed on the liner;

means for supplying heat to at least the circumference of the second corrugating roll;

a wrapped roll disposed opposite the second corrugating roll in the line of feeding the corrugating medium and the liner on the downstream side of the introducing means and spaced apart from the second corrugating roll so as not to bring the corrugating medium and the liner into press contact with the second corrugating roll and for wrapping the corrugating medium and the liner over a required wrapping area on the circumference of the second corrugating roll; and position adjusting and control means for moving the wrapped roll with reference to the second corrugating roll depending on feeding speed, type of material or thickness of the corrugating medium and the liner to move the corrugating medium and the liner with respect to the second corrugating roll so that the wrapping area of the corrugating medium and the liner about the circumference of the second corrugating roll is adjusted to achieve a substantially complete bonding of the corrugating medium with the liner.

2. The single facer according to claim 1, wherein the introducing means is disposed to be able to move closer to or farther from the second corrugating roll via a gap adjusting mechanism, and after a gap to be defined between the opposing portions of the introducing means and the second corrugating roll is adjusted depending on the total thickness of the thickness of the corrugating medium plus the thickness of the liner, the single facer is designed to be operated in a state where the gap between the second corrugating roll and the introducing means is not changed.

3. The single facer according to claim 1, wherein the wrapped roll is driven to rotate at a speed higher than a circumferential speed of the second corrugating roll so that the corrugating medium and the liner present between the introducing means and the wrapped roll may be brought into press contact with the circumference of the second corrugating roll by the tension generated by the difference between a circumferential speed of the wrapped roll and that of the second corrugating roll.

4. The single facer according to claim 1, 2 or 3, wherein said heat supplying means distributes high-temperature steam into the second corrugating roll to heat the circumference of the second corrugating roll to a predetermined temperature.

5. The single facer according to claim 1, 2 or 3, wherein the introducing means is a roll which is rotated with feeding of the liner.

6. A single facer, comprising first and second corrugating rolls for corrugating a corrugating medium, a roll for pressing a liner against the corrugated corrugating medium with a predetermined small nip pressure so that substantially no press marks are formed on the liner, a gluing mechanism for applying glue to the corrugated corrugating medium or the liner, means for supplying heat to at least the circumference of the second corrugating roll, a wrapped roll spaced apart from the second corrugating roll a distance greater than a thickness of the corrugating medium and the liner and positioned to wrap the corrugating medium and the liner over a wrapping area on the outer surface of the second corrugating roll, and position adjusting means for moving the wrapped roll relative to the second corrugating roll while maintaining the spaced apart distance between the wrapped roll and second corrugating roll to move the liner and the corrugated corrugating medium about a portion of the circumference of the second corrugating roll, said portion defining a wrapping area, including means for adjusting the wrapping area by adjusting the moving of the wrapped roll to achieve substantially complete bonding of the liner and the corrugating medium.

7. The single facer according to claim 6, wherein the wrapped roll is driven to rotate at a higher speed than the second corrugating roll to generate a tension which presses the corrugating medium and the liner against the outer surface of the second corrugating roll.

8. The single facer according to claim 1, wherein said position adjusting and control means moves the wrapped roll so as to complete the adhesion between the corrugating medium and the liner over the wrapping area on the circumference of the second corrugating roll.

9. An apparatus for forming a single faced corrugated web from a liner and a corrugating medium comprising:

a first corrugating roll having wavy flutes formed on the circumference;

a second corrugating roll having wavy flutes formed on the circumference to be engageable with the flutes of the first corrugating roll for forming a corrugation on the corrugating medium to be passed between the two rolls;

means for applying a glue adhesive to the exposed flute tips of said corrugated corrugating medium to form adhesive glue lines on said flute tips;

means for joining the liner with the corrugated corrugating medium on the second corrugating roll such that the adhesive glue lines are between the liner and said flute tips;

means for heating the outer surface of the second corrugating roll to a selected bonding temperature; and means for adjustably wrapping the glued single faced corrugated web around a portion of the circumference of the second corrugating roll downstream of the point of joining the liner with the corrugated corrugating medium sufficient to cause substantially complete bonding of the corrugated corrugating medium with the liner while the glued single faced corrugated web is wrapped around the portion of the second corrugating roll, said portion defining a wrapping area;

wherein said means for adjustably wrapping includes means for adjusting the wrapping area to obtain a sufficient amount of heat, at the selected bonding temperature, which is supplied from the outer surface of the second corrugated roll for completely bonding the corrugating medium with the liner.

10. The apparatus as set forth in claim 9 wherein said joining means comprises a rotatable liner roll carrying the liner thereon and forming with the second corrugating roll a nip for said liner and the glued corrugated corrugating medium.

11. The apparatus as set forth in claim 9 wherein the adjustably wrapping means is a wrapping roll.

12. The apparatus as set forth in claim 11 wherein the wrapping roll is a guide roller.

13. The single facer according to claim 11, wherein the wrapping roll is driven to rotate at a higher speed than the second corrugating roll to generate a tension which presses the corrugating medium and the liner against the outer surface of the second corrugating roll.

* * * * *